US009239552B2

(12) United States Patent
Iida et al.

(10) Patent No.: US 9,239,552 B2
(45) Date of Patent: Jan. 19, 2016

(54) TRANSFER DEVICE AND IMAGE FORMING APPARATUS COMPRISING THE SAME

(71) Applicant: CANON KABUSHIKI KAISHA, Tokyo (JP)

(72) Inventors: Kenichi Iida, Tokyo (JP); Takao Kume, Yokohama (JP); Yusuke Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/526,297

(22) Filed: Oct. 28, 2014

(65) Prior Publication Data

US 2015/0117915 A1 Apr. 30, 2015

(30) Foreign Application Priority Data

Oct. 30, 2013 (JP) ..... 2013-225591

(51) Int. Cl.
*G03G 15/16* (2006.01)

(52) U.S. Cl.
CPC ..... *G03G 15/167* (2013.01); *G03G 15/1605* (2013.01); *G03G 15/1665* (2013.01); *G03G 15/1685* (2013.01); *G03G 2215/0129* (2013.01); *G03G 2215/1642* (2013.01)

(58) Field of Classification Search
CPC ..... G03G 15/1665; G03G 15/1685; G03G 2215/1642
See application file for complete search history.

(56) References Cited

U.S. PATENT DOCUMENTS

| | | | | |
|---|---|---|---|---|
| 5,508,879 | A * | 4/1996 | Kitamura et al. | 361/221 |
| 6,006,062 | A * | 12/1999 | Takahashi et al. | 399/310 |
| 2007/0014597 | A1 * | 1/2007 | Ishii | 399/310 |
| 2014/0161496 | A1 * | 6/2014 | Akamatsu et al. | 399/313 |

FOREIGN PATENT DOCUMENTS

| | | | |
|---|---|---|---|
| JP | 5-127546 | A | 5/1993 |
| JP | 6-67550 | A | 3/1994 |
| JP | 7-84434 | A | 3/1995 |
| JP | 4613586 | B2 | 1/2011 |
| JP | 2011-248385 | A | 12/2011 |

* cited by examiner

*Primary Examiner* — Rodney Bonnette
(74) *Attorney, Agent, or Firm* — Canon USA Inc. IP Division

(57) ABSTRACT

A position of a contact region formed between a transfer belt and a transfer member in the form of a brush is displaced toward a downstream side in a movement direction of the transfer belt with respect to the position in an initial state, whereby it is difficult to acquire excellent transferability. An image forming apparatus, in which a plurality of conductive fibers contacts an inner circumferential surface of the transfer belt, includes a support device configured to support the transfer member in such a manner that the plurality of conductive fibers is pressed between the support device and the transfer belt. A tilt amount of the conductive fiber, which is generated due to a movement of the transfer belt, is smaller than a length of a region where an image bearing member and the transfer belt contact each other in the movement direction of the transfer belt.

14 Claims, 14 Drawing Sheets

TRANSFER DEVICE AND IMAGE FORMING APPARATUS COMPRISING THE SAME

BACKGROUND OF THE INVENTION

1. Field of the Invention

The present invention relates to an image forming apparatus that forms an image by the electrophotographic method such as a copying machine, a printer, a facsimile apparatus, and a multifunction peripheral.

2. Description of the Related Art

Conventionally, there has been an image forming apparatus that employs the electrophotographic method and operates according to a method employing an intermediate transfer belt as a transfer belt, as an image forming apparatus such as a copying machine and a printer. The image forming apparatus that operates according to the intermediate transfer belt method forms a full-color image by being subjected to a primary transfer process and a secondary transfer process.

During the primary transfer process, the image forming apparatus primarily transfers a toner image formed on a surface of an electrophotographic photosensitive member onto the intermediate transfer belt. The image forming apparatus forms toner images of a plurality of colors on a surface of the intermediate transfer belt by repeatedly performing the primary transfer process regarding the toner images of the plurality of colors. During the secondary transfer process, the image forming apparatus collectively transfers the toner images of the plurality of colors onto a surface of a transfer material such as paper. The toner images transferred onto the transfer material are fixed by a fixing device thereafter. As a result, a full-color image can be acquired.

A transfer device in the form of a roller, a transfer device in the form of a blade, a transfer device in the form of a brush, or the like is used as a transfer device of the image forming apparatus. These transfer devices are contact members that contact an inner circumferential surface (a back surface) of the intermediate transfer belt at a position facing the photosensitive member. Especially, the transfer device in the form of a brush includes a plurality of conductive fibers, and each one of the fibers can independently contact the back surface of the intermediate transfer belt. Therefore, the transfer device in the form of a brush can improve contact unevenness, which occurs when the transfer device in the form of a roller or the transfer device in the form of a blade is used. As a result, more even contactability can be obtained with the back surface of the intermediate transfer belt. This facilitates prevention or a reduction of an image defect such as density unevenness, which otherwise occurs during the primary transfer process.

Japanese Patent Application Laid-Open No. 2011-248385 discusses an image forming apparatus including a transfer device in the form of a brush. In the image forming apparatus discussed in Japanese Patent Application Laid-Open No. 2011-248385, a plurality of conductive fibers included in the brush is supported by a stainless-steel metallic holder via a double-faced adhesive tape. This metallic holder is fixed, and the plurality of conductive fibers included in the transfer member is in contact with a back surface of an intermediate transfer belt with the aid of elasticity of the fibers themselves.

However, the transfer device in the form of a brush is difficult to maintain excellent primary transferability, so that there has been a demand for development of various kinds of measures to improve it. The transfer device in the form of a brush can maintain each one of the fibers in perpendicular contact with the back surface of the intermediate transfer belt when the image forming apparatus is in an initial state. However, in a state after the image forming apparatus has been used, the fibers are tilted toward a downstream side in a movement direction of the intermediate transfer belt, whereby each one of the fibers is in contact with the back surface of the intermediate transfer belt in a bent state. At this time, a position of a contact region formed between the intermediate transfer belt and the fibers is displaced toward the downstream side in the movement direction of the intermediate transfer belt with respect to the position in the initial state. A large displacement of this contact region from the position facing the photosensitive member impairs the excellent primary transferability. Further, not only when the intermediate transfer belt is used as the transfer belt but also when a conveyance belt for conveying the transfer material is used as the transfer belt, this problem occurs in a similar manner.

SUMMARY OF THE INVENTION

The present invention is directed to an image forming apparatus capable of preventing a transfer device including fibers from largely displacing a position of a contact region formed between the fibers and a transfer belt toward a downstream side in a movement direction of the transfer belt due to a movement of the transfer belt, thereby sustainably securing excellent transferability.

The above-described object can be achieved by an image forming apparatus according to the present invention. According to an aspect of the present invention, an image forming apparatus includes an image bearing member configured to bear a toner image, an endless transfer belt movable while being in contact with the image bearing member, and a transfer device configured to transfer the toner image from the image bearing member toward the transfer belt. The transfer device is a transfer member in the form of a brush that includes a plurality of conductive fibers, and the plurality of conductive fibers is in contact with an inner circumferential surface of the transfer belt. The image forming apparatus further includes a support device configured to support the transfer device in such a manner that the plurality of conductive fibers is pressed between the support device and the transfer belt. The conductive fiber is configured in such a manner that a maximum value of a fiber tilt amount of the conductive fiber, which is generated due to a movement of the transfer belt, is smaller than a length of a region where the image bearing member and the transfer belt are in contact with each other in a movement direction of the transfer belt.

Further features of the present invention will become apparent from the following description of exemplary embodiments with reference to the attached drawings.

DESCRIPTION OF THE EMBODIMENTS

In the following description, exemplary embodiments of the present invention will be described in detail by way of example with reference to the drawings. However, dimensions, materials, shapes, a relative layout, and the like of components described in the exemplary embodiments that will be described below shall be arbitrarily changed according to a configuration of an apparatus to which the present invention is applied, and various kinds of conditions. Therefore, unless especially specifically indicated, theses exemplary embodiments are not intended to limit the scope of the present invention only thereto.

1. Overall Configuration of Image Forming Apparatus

Figure 1:
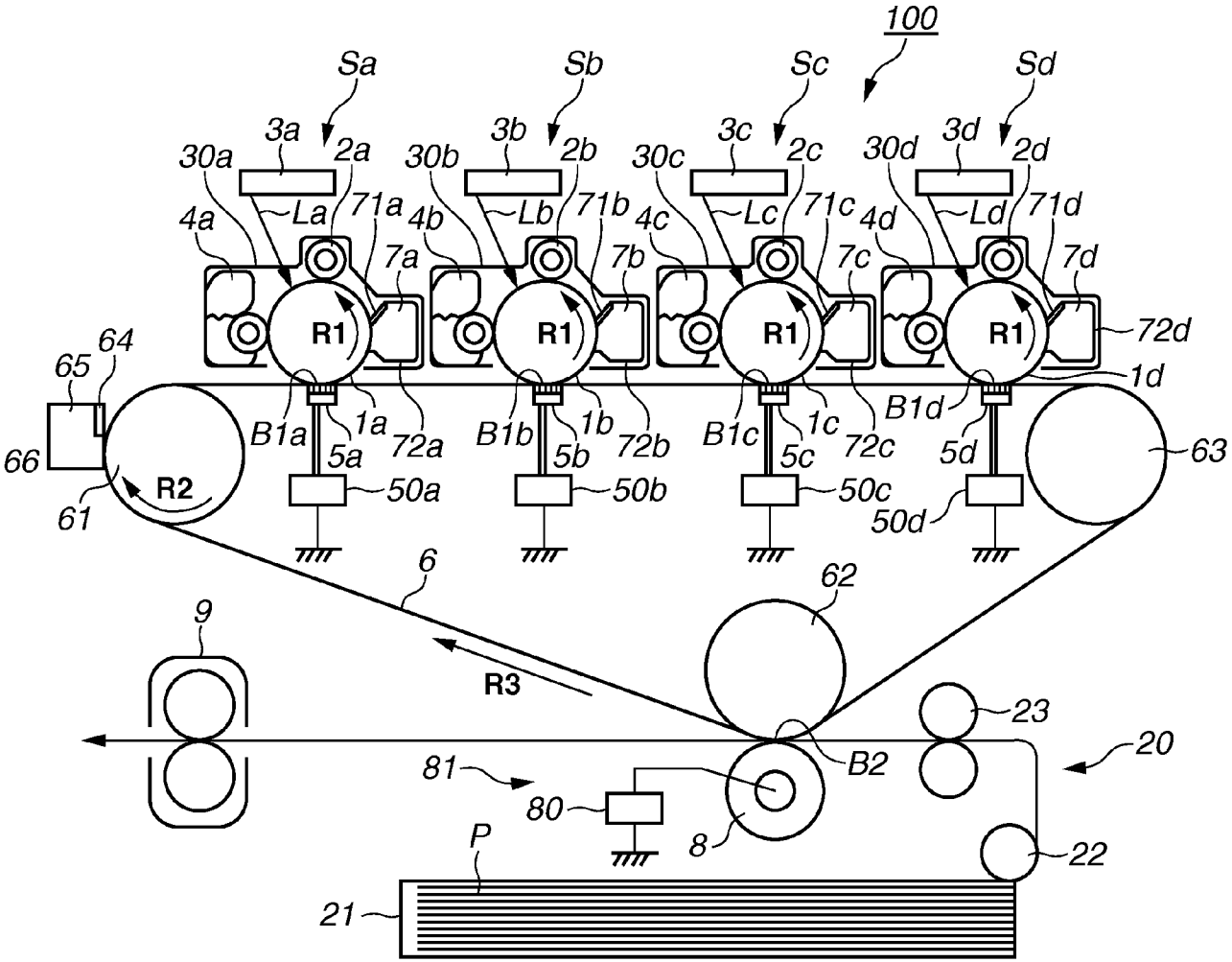
FIG. 1 is a cross-sectional view illustrating an overview of an image forming apparatus according to a first exemplary embodiment.

FIG. 1 is a cross-sectional view illustrating an overview of an image forming apparatus according to a first exemplary embodiment. The image forming apparatus 100 according to the first exemplary embodiment is an electrophotographic type full-color laser-beam printer. The image forming apparatus 100 can form an image on a transfer material such as recording paper and an overhead projector (OHP) sheet by the electrophotographic method according to a signal transmitted from an external apparatus such as a personal computer communicably connected to the image forming apparatus 100.

Further, the present image forming apparatus 100 is a tandem type image forming apparatus that uses the intermediate transfer method. More specifically, the present image forming apparatus 100 acquires a recorded image by sequentially transferring toner images of respective colors formed according to image information divided into a plurality of color components onto an intermediate transfer member while superimposing them as a primary transfer, and then collectively transferring the toner images onto the transfer material as a secondary transfer.

The image forming apparatus 100 sequentially transfers the toner images of the respective colors formed according to the image information divided into the plurality of color components onto an intermediate transfer belt 6 serving as the intermediate transfer member while superimposing them as the primary transfer, and then collectively transfers the toner images onto a transfer material P as the secondary transfer. The intermediate transfer belt 6 corresponds to a transfer belt. The image forming apparatus 100 acquires the recorded image by fixing these toner images onto the transfer material P. The image forming apparatus 100 includes first, second, third, and fourth stations Sa, Sb, Sc, and Sd as a plurality of image forming portions. In the present exemplary embodiment, the first to fourth stations Sa to Sd form toner images of yellow (Y), magenta (M), cyan (C), and black (K) colors, respectively.

In the present exemplary embodiment, configurations and operations of the first to fourth stations Sa to Sd are substantially similar to one another except for a difference among the colors of toner used therein. Therefore, hereinafter, the first to fourth stations Sa to Sd will be described collectively, omitting alphabets a, b, c, and d that are added at the ends of reference numerals for indicating which color that element is provided for, unless there is a necessity for distinguishing them especially.

The station S includes a photosensitive drum 1, which is a drum-type electrophotographic photosensitive member as an image bearing member. The photosensitive drum 1 is rotationally driven by a motor (not illustrated) as a driving device in a direction indicated by an arrow R1 (the counterclockwise direction) in FIG. 1. The following respective devices are disposed around the photosensitive drum 1 in the following order along the rotational direction of the photosensitive drum 1. First, a charging roller 2, which is a charging device, is disposed. Next, a laser scanner 3 as an exposure device is disposed. Next, a development device 4 is disposed. Next, a primary transfer brush 5, which is a transfer device, is disposed. Lastly, a drum cleaner 7 as a photosensitive member cleaning device is disposed.

Further, the intermediate transfer belt 6, which is an endless belt, is disposed as the transfer belt so as to be located facing the respective photosensitive drums 1 of the respective stations S. The intermediate transfer belt 6 is made of a cylindrical and endless film, and is stretched among tree rollers, i.e., a driving roller 61, a secondary transfer counter roller 62, and a tension roller 63. The driving roller 61 is rotationally driven in a direction indicated by an arrow R2 (clockwise direction) in FIG. 1, by which the intermediate transfer belt 6 circulates and moves (rotates) in a direction indicated by an arrow R3 (clockwise direction) in FIG. 1. In the present exemplary embodiment, a movement speed (circumferential speed) of a surface of the photosensitive drum 1 and a movement speed (circumferential speed) of a surface of the intermediate transfer belt 6 are substantially equal.

A plurality of primary transfer brushes 5 is disposed on an inner circumferential surface (back surface) side of the intermediate transfer belt 6 at positions facing the respective photosensitive drums 1 via the intermediate transfer belt 6. As will be described in detail below, the primary transfer brush 5 is pressed against the back surface of the intermediate transfer belt 6. This pressing places the photosensitive drum 1 and the intermediate transfer belt 6 into contact with each other, by which a primary transfer portion B1 is formed therebetween. Further, a secondary transfer roller 8 in the form of a roller is disposed as a secondary transfer member on an outer circumferential surface (front surface) side of the intermediate transfer belt 6 at a position facing the secondary transfer counter roller 62 via the intermediate transfer belt 6. The secondary transfer roller 8 is pressed against the secondary transfer counter roller 62 via the intermediate transfer belt 6. This pressing places the intermediate transfer belt 6 and the secondary transfer roller 8 into contact with each other, by which a secondary transfer portion B2 is formed therebetween. Further, a belt cleaner 65 as an intermediate transfer member cleaning device is disposed at a position facing the driving roller 61 via the intermediate transfer belt 6 from.

At the time of image formation, the surface of the rotating photosensitive drum 1 is evenly charged by the charging roller 2. At this time, a predetermined charging voltage (a charging bias) is applied from a charging power source (not illustrated) to the charging roller 2. Laser light L according to the image information is emitted onto the charged surface of the photosensitive drum 1 by the laser scanner 3. As a result, an electrostatic latent image is formed on the photosensitive drum 1.

The electrostatic latent image formed on the photosensitive drum 1 is developed (visualized) by the development device 4 as the toner image. The development device 4 causes a rotatable developer bearing member to bear the toner as a developer, conveys the toner to a portion (a development position) facing the photosensitive drum 1, and supplies the toner onto the photosensitive drum 1 according to the electrostatic latent image formed on the photosensitive drum 1. At this time, a predetermined development voltage (development bias) is applied from a development power source (not illustrated) to the developer bearing member. In the present exemplary embodiment, the development device 4 develops the electrostatic latent image formed on the photosensitive drum 1 by the reversal developing method. More specifically, the development device 4 attaches the toner charged so as to have the same polarity as the charged polarity (negative polarity in the present exemplary embodiment) of the photosensitive drum 1 onto an image portion (exposed portion) on the photosensitive drum 1 that is exposed after being charged so as to have an electric potential of a reduced absolute value, thereby developing the electrostatic latent image.

The toner image formed on the rotating photosensitive drum 1 is transferred onto the rotating intermediate transfer belt side at the primary transfer portion B1 with the aid of the primary transfer brush 5 (primary transfer). At this time, a voltage is applied from a primary transfer power source 50 as a voltage application device to the primary transfer brush 5. This voltage is a primary transfer voltage, which is a direct-current voltage having a reverse polarity (positive polarity in the present exemplary embodiment) of the normal charged polarity (negative polarity in the present exemplary embodiment) of the toner forming the toner image.

Toner remaining on the photosensitive drum 1 without being transferred onto the intermediate transfer belt 6 during the primary transfer process (primary transfer residual toner) is removed by the drum cleaner 7. The drum cleaner 7 includes a cleaning blade 71, which is a plate-like elastic body in abutment with the surface of the photosensitive drum 1, and a collected toner container 72. The cleaning blade 71 is a cleaning member for removing the toner attached onto the surface of the photosensitive drum 1. The toner removed from the surface of the rotating photosensitive drum 1 by the cleaning blade 71 is collected into the collected toner container 72.

For example, at the time of formation of a full-color image, the above-described charging, exposure, development, and primary transfer processes are performed at the first to fourth stations Sa to Sd from an upstream side in a movement direction of the surface of the intermediate transfer belt 6 in order. As a result, multiple toner images for the full-color image, in which the toner images of the four colors, i.e., yellow, magenta, cyan, and black are transferred so as to be superimposed, are formed on the intermediate transfer belt 6.

The toner images formed on the intermediate transfer belt 6 are transferred onto the transfer material P at the secondary transfer portion B2 with the aid of the secondary transfer roller 8 (secondary transfer). More specifically, after the transfer material P contained in a cassette 21 is fed by a supply roller 22 at a transfer material supply portion 20, the transfer material P is supplied to the secondary transfer portion B2 by a registration roller 23 at a predetermined timing. Substantially at the same time as that, a secondary transfer voltage (a secondary transfer bias), which is a direct-current voltage having the reverse polarity of the normal charged polarity of the toner forming the toner images, is applied from a secondary transfer power source serving as a secondary transfer voltage application device to the secondary transfer roller 8.

Toner remaining on the intermediate transfer belt 6 without being transferred onto the transfer material P during the secondary transfer process (secondary transfer residual toner) is removed by the belt cleaner 65. The belt cleaner 65 includes a cleaning blade 64, which is a plate-like elastic body in abutment with the surface of the intermediate transfer belt 6, and a collected toner container 66. The cleaning blade 64 is a cleaning member for removing the toner attached onto the surface of the intermediate transfer belt 6. The toner removed from the surface of the rotating intermediate transfer belt 6 by the cleaning blade 64 is collected into the collected toner container 66.

The transfer material P with the toner images transferred thereon by the secondary transfer is conveyed to a fixing device 9. The fixing device 9 heats and presses the transfer material P while conveying it. The toner images unfixed on the transfer material P are fixed onto the transfer material P with the aid of the heat and the pressure. After that, the transfer material P is conveyed out of the apparatus by a conveyance roller (not illustrated).

The image forming apparatus 100 according to the present exemplary embodiment is a printer that operates at a speed of 116 mm/s as a process speed corresponding to the circumferential speeds of the photosensitive drum 1 and the intermediate transfer belt 6, and that can form an image onto the transfer material P of an A4 size. Further, in the present exemplary embodiment, the photosensitive drum 1 has a diameter of 20 mm.

Further, in the present exemplary embodiment, a polyimide resin film having a thickness of 60 μm and a volume resistivity adjusted to $10^9$ Ωcm by mixing a conductive agent is used as the intermediate transfer belt 6. This intermediate transfer belt 6 is stretched around the three axes, i.e., the driving roller 61, the secondary transfer counter roller 62, and the tension roller 63, and a tensile force of approximately 20 N in total is applied to the intermediate transfer belt 6 by the tension roller 63.

Further, in the present exemplary embodiment, an elastic body roller having a volume resistivity of $10^7$ to $10^9$ Ωcm and a hardness of 30 to 40 degrees is used as the secondary transfer roller 8. This secondary transfer roller 8 is pressed against the secondary transfer counter roller 62 via the intermediate transfer belt 6 with a total force of approximately 39.2 N. This secondary transfer roller 8 rotates according to a rotation of the intermediate transfer belt 6 by being driven by this rotation. Further, the secondary transfer voltage of 0 to 4.0 kV can be applied from the secondary transfer power source 80 to the secondary transfer roller 8.

2. Primary Transfer Brush

Figure 2:
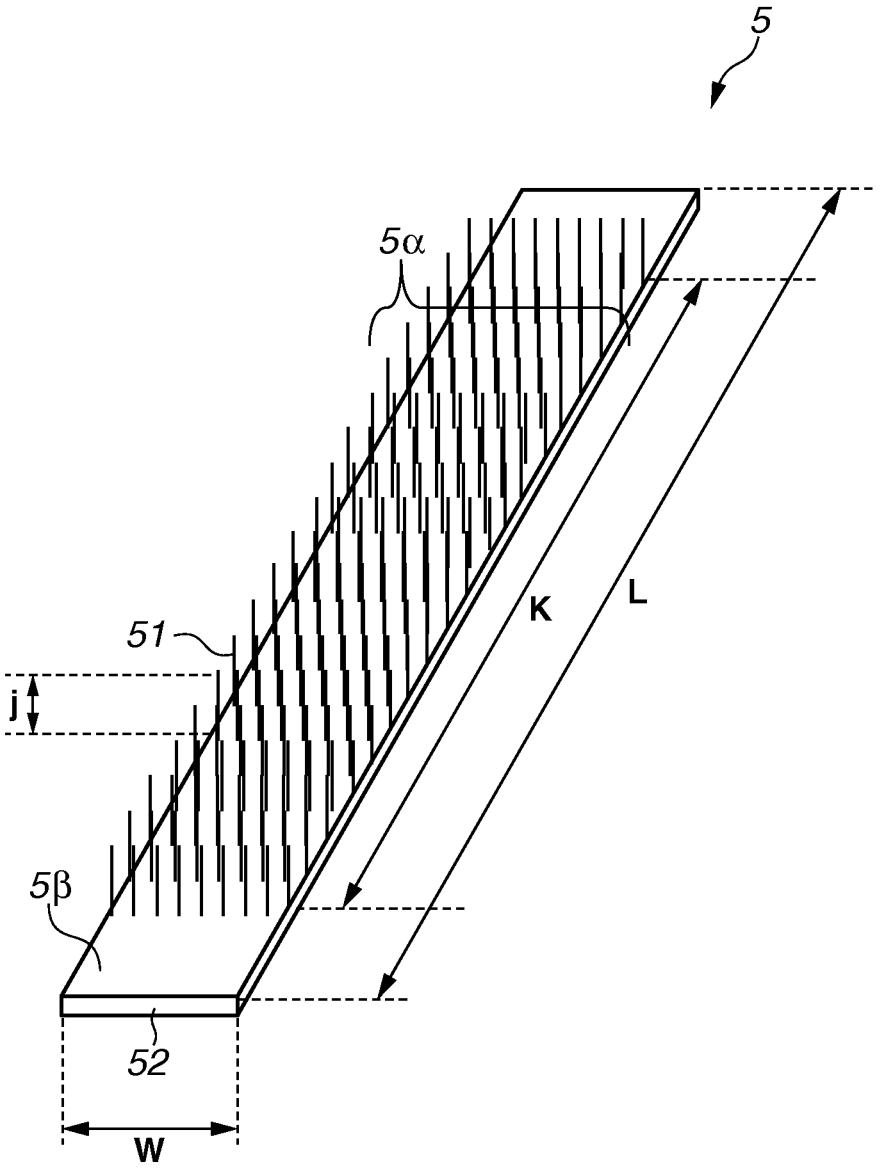
FIG. 2 is a schematic perspective view illustrating a primary transfer brush according to the first exemplary embodiment.

A configuration of the primary transfer brush 5 will be described. FIG. 2 is a schematic perspective view illustrating the configuration of the primary transfer brush 5. The primary transfer brush 5 according to the present exemplary embodiment includes a fibered portion 5α having a plurality of conductive fibers 51, and a non-fibered portion 5β supporting the fibered portion 5α. The plurality of conductive fibers 51 included in the fibered portion 5α is densely arrayed.

In the present exemplary embodiment, the primary transfer brush 5 has a dimension W of 3 mm in a lateral direction of the primary transfer brush 5. The lateral direction of the primary transfer brush 5 is a direction in parallel with the movement direction of the intermediate transfer belt 6. Further, the primary transfer brush 5 has a dimension L of 250 mm in a longitudinal direction of the primary transfer brush 5. The longitudinal direction of the primary transfer brush 5 is a direction perpendicular to the movement direction of the intermediate transfer belt 6.

In the dimension L of the primary transfer brush 5 in the longitudinal direction, the region (fibered portion) 5α provided with the conductive fibers 51 has a dimension K of 230 mm. Then, regions where the conductive fibers 51 are not provided, each of which has a dimension of 10 mm, are substantially evenly formed at both ends of the primary transfer brush 5 in the longitudinal direction.

In the present exemplary embodiment, the primary transfer brush 5 has the dimension W of 3 mm in the lateral direction of the primary transfer brush 5, by which a region where the primary transfer brush 5 and the intermediate transfer belt 6 are in contact with each other can be formed so as to have a sufficient width. Further, the fibered portion 5α has the dimension K of 230 mm in the longitudinal direction of the primary transfer brush 5, by which the primary transfer brush 5 can have a sufficient width as a primary transfer device even for the transfer material P of an A4 size that may be conveyed to the primary transfer portion B1.

A pile fabric type brush member or an electrostatic flocking type brush member can be used as the primary transfer brush 5.

The pile fabric is a fabric formed by weaving pile yarns, which become the conductive fibers 51, into spaces in a foundation cloth (non-fibered portion 5β) constituted by warp and woof. The first transfer brush 5, which is a brush member, can be acquired by fixing this fabric by, for example, bonding it onto a base plate 52 with use of a conductive adhesive or the like.

On the other hand, the electrostatic flocking is a method that uses an electrostatic attraction force in a high voltage electrostatic field to substantially perpendicularly anchor short fibers, which become the conductive fibers 51, onto the base plate 52 (also serving as the non-fibered portion 5β) with a conductive adhesive applied thereon in advance. The first transfer brush 5, which is the brush member, can be also acquired by this method.

A conductive fiber, especially, a synthetic fiber containing a conductive agent, can be used as the conductive fiber 51. For example, a fiber made from nylon, polyester, acrylic, or the like with carbon powder distributed therein can be used as the conductive fiber 51. Further, a fiber having a single fiber fineness of 1 to 15 dtex and a Young's modulus within the range of 500 to 3000 MPa can be used as the conductive fiber 51. It is desirable that a resistivity ρ fiber of the conductive fiber 51 is within the range of $10^2$ to $10^8$ Ωcm in light of improvement of transfer efficiency or the like.

The resistivity ρ fiber is measured by the following method. Fifty fibers are bundled together into a single bundle, and metallic probes are placed into contact with a surface of the bundle at an interval of approximately 1 cm. Then, a resistance value R fiber is actually measured with use of a high resistance meter Advantest R8340A (manufactured by Advantest Corporation) or the like with a voltage of 100 V applied thereto, and the resistivity ρ fiber is calculated by the following formula. In this formula, ϕf represents a diameter of the fiber.

$$\rho\text{fiber}=R\text{fiber}\times(\phi f/2)^2\times 3.14\times 50 \qquad \text{(FORMULA 1)}$$

In the present exemplary embodiment, the primary transfer brush 5 is formed by fixing the fibered portion 5α constituted by the foundation cloth (the non-fibered portion) 5β and the pile yarns onto a top surface of the substantially evenly flat stainless-steel base plate 52. The base plate 52 is a rectangular steel metal having the above-described dimension W as a dimension thereof in the lateral direction, and the above-described dimension L as a dimension thereof in the longitudinal direction. Then, in the present exemplary embodiment, the conductive fibers 51 constituted by the pile yarns woven into the pile fabric are erected in a substantially perpendicular direction (normal direction) with respect to the top surface of the base plate 52.

A free length of each of the conductive fibers 51 from the top surface of the base plate 52 is referred to as a fiber length j, and can be 0.5 to 2.5 mm. Further, a density at which the conductive fibers 51 are arrayed on the base plate 52 can be 200 to 800 F/$m^2$.

As described above, if the primary transfer brush 5 is the pile fabric type brush, the conductive adhesive for bonding the foundation cloth and the pile fabric is applied on the base plate 52. If the primary transfer brush 5 is the electrostatic flocking type brush, the conductive adhesive for anchoring the fibers is applied on the base plate 52. These conductive adhesives can be considered as a part of components of the base plate 52. In other words, the fiber length j of the primary transfer brush 5 of each type can be considered as a length of a portion of the brush fiber that protrudes from the foundation cloth or the conductive adhesive. Therefore, the conductive adhesive is not illustrated in FIG. 2 and the other drawings of the present disclosure.

In the present exemplary embodiment, a brush member with the following specification is used as the primary transfer brush 5 having representative characteristics.

<Specification of Primary Transfer Brush According to Present Exemplary Embodiment>

MEMBER TYPE: PILE FABRIC

MATERIAL OF BRUSH FIBER: NYLON FIBER WITH CARBON POWDER DISTRIBUTED THEREIN

SINGLE FIBER FINENESS OF BRUSH FIBER: 2.5 dtex

DIAMETER OF BRUSH FIBER: 17 μm

YOUNG'S MODULUS OF BRUSH FIBER: 1500 MPa

RESISTIVITY OF BRUSH FIBER: $10^5$ Ωcm

FIBER LENGTH (j): 1.3 mm

ARRAY DENSITY: 418 F/$mm^2$

The above-described primary transfer brush 5 is in abutment with the back surface of the intermediate transfer belt 6 at the position opposite of the intermediate transfer belt 6 from the photosensitive drum 1. Further, the primary transfer voltage of 0 to 2.0 kV can be applied from the primary transfer power source 50 to the primary transfer brush 5.

3. Configuration of Support Device of Primary Transfer Brush 5

Figure 3:
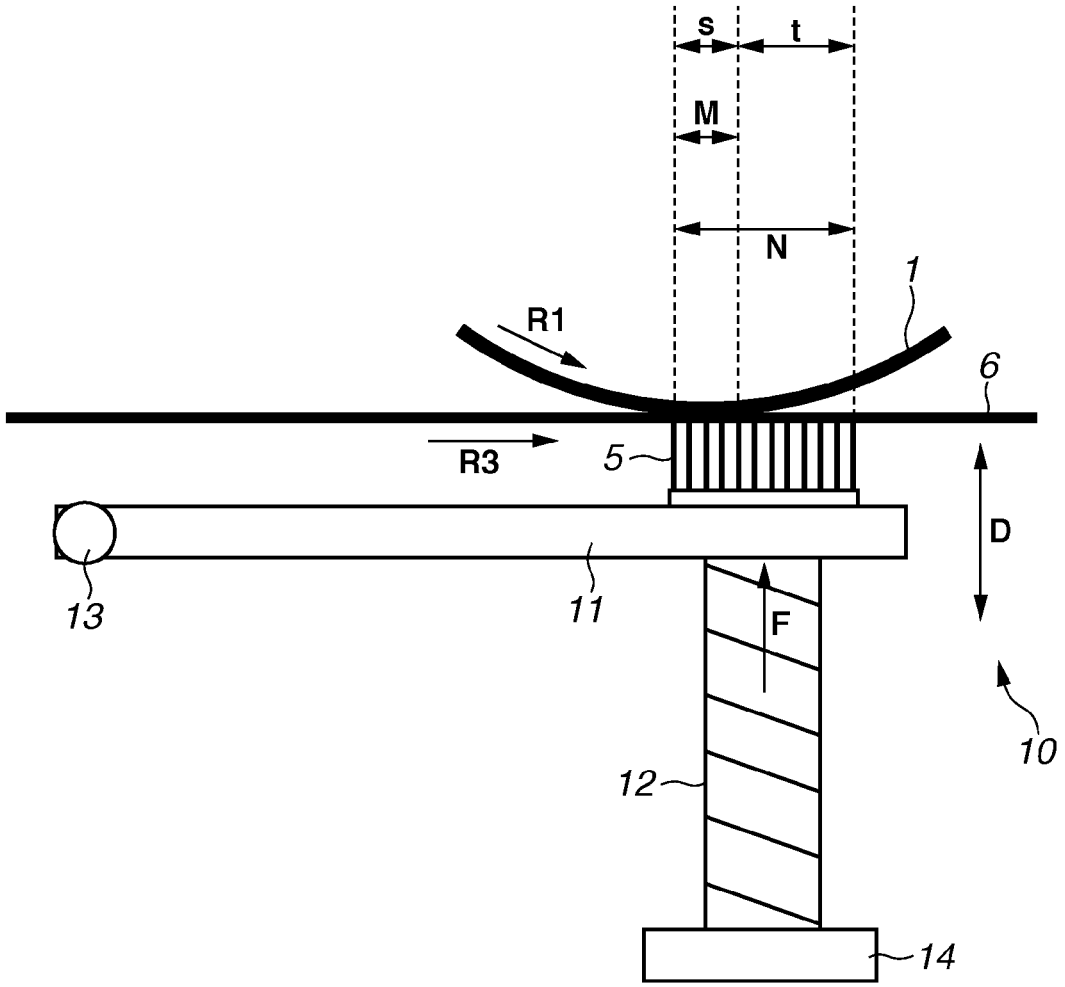
FIG. 3 illustrates a configuration of a support device of the primary transfer brush and respective contact regions according to the first exemplary embodiment.

Next, a support device of the primary transfer brush 5 will be described. FIG. 3 is a schematic cross-sectional view illustrating a support device 10 that supports the primary transfer brush 5 at each of the primary transfer portions B1. FIG. 3 illustrates the support device 10 as viewed from one end of the primary transfer brush 5 in the longitudinal direction. FIG. 3 illustrates the image forming apparatus 100 in an initial state (a state immediately after the primary transfer brush 5 is mounted on the image forming apparatus 100, and the image forming apparatus 100 starts to be used). The primary transfer portions B1a to B1d of the respective stations Sa to Sd are configured similarly to one another.

The primary transfer brush 5 of the image forming apparatus 100 according to the present exemplary embodiment is mounted movably in a direction toward and a direction away from the inner circumferential surface of the intermediate transfer belt 6 by the support device 10. The support device 10 includes a support portion 11, a compressed coil spring (hereinafter simply referred to as a "spring") 12 as a biasing member, a rotational shaft 13, and a spring bearing 14.

The support device 10 holds the primary transfer brush 5 by the support portion 11 rotatable about the rotational shaft 13. A bottom surface (surface opposite side of the top surface where the conductive fibers 51 are erected) of the base plate 52 of the primary transfer brush 5 is fixed onto a top surface of the support portion 11 by a method such as adhesion, welding, fastening, and engagement. The top surface of the support portion 11 has a substantially similar shape to the bottom surface of the base plate 52 of the primary transfer brush 5. The top surface of the base plate 52 of the primary transfer brush 5 and the top surface of the support portion 11 extend in parallel with each other. Further, the base plate 52 of the primary transfer brush 5 and the back surface of the intermediate transfer belt 6 are in a substantially parallel relationship.

The rotational shaft 13 is disposed on an upstream side of the primary transfer brush 5 in the movement direction of the intermediate transfer belt 6, and its rotational axial direction extends in parallel with a rotational axial direction of the photosensitive drum 1 (direction perpendicular to the movement direction R3 of the intermediate transfer belt 6). The single spring 12 is disposed at each of the both ends of the primary transfer brush 5 in the longitudinal direction, and is held between the bottom surface of the support portion 11 and the spring bearing 14.

The primary transfer brush 5 is pressed toward the photosensitive drum 1 via the intermediate transfer belt 6, and is placed into abutment with the inner circumferential surface of the intermediate transfer belt 6 by the support device 10. The rotational shaft 13 and the support portion 11 rotatable about the rotational shaft 13 limit both a direction in which the primary transfer brush 5 is movable and a direction in which a pressing force by the spring 12 is applied to a direction substantially in parallel with a direction indicated by an arrow D in FIG. 3. In the present exemplary embodiment, a biasing force F is 3.92 N (400 gf) when the primary transfer brush 5 is pressed toward the intermediate transfer belt 6.

Further, the direction in which the primary transfer brush 5 is movable and the direction in which the biasing force F is applied as indicated by the arrow D in FIG. 3 are substantially perpendicular to the inner circumferential surface of the intermediate transfer belt 6 at the primary transfer portion B1. In this manner, the plurality of conductive fibers 51 is pressed by the support device 10 between the intermediate transfer belt 6 and the surface of the support portion 11 that supports the conductive fibers 5. At this time, the plurality of conductive fibers 51 is substantially perpendicularly in contact with the back surface of the intermediate transfer belt 6 while being maintained in a fiber erected state immediately after the primary transfer brush 5 is mounted on the image forming apparatus 100, i.e., such a state that the fibers are erected substantially perpendicularly to the top surface of the base plate 52.

If the primary transfer brush 5 is the pile fabric type brush, the primary transfer brush 5 may be configured in such a manner that each one of the pile yarns as the brush fibers spreads outwardly as it gets farther away from the base plate 52. Even in this case, each of the conductive fibers 51 constituting the pile yarns can be considered to be erected substantially perpendicularly to the top surface of the base plate 52 and be substantially perpendicularly in contact with the inner circumferential surface of the intermediate transfer belt 6 as an average orientation of each one of the fibers.

4. Layout of Respective Contact Regions at Primary Transfer Portion

A layout of respective contact regions at the primary transfer portion B1 will be described. FIG. 3 also illustrates a positional relationship among the respective members and the respective contact regions at the primary transfer portion B1.

A region labeled "M" in FIG. 3 is a first contact region where the photosensitive drum 1 and the intermediate transfer belt 6 are in contact with each other, and is referred to as a physical nip M. In the present exemplary embodiment, the intermediate transfer belt 6 linearly stretched between the driving roller 61 and the tension roller 63 forms the physical nip M having a width of 1.0 mm in the movement direction of the intermediate transfer belt 6, between the intermediate transfer belt 6 and the photosensitive drum 1 for each station S. The width of the physical nip M can be measured by the following method. First, marking liquid such as dye is applied onto the surface of the intermediate transfer belt 6 with the photosensitive drum 1 removed from the image forming apparatus 100. Next, the photosensitive drum 1 is mounted on the image forming apparatus 100 first, and then is removed from the image forming apparatus 100 again. The width of the physical nip M can be acquired by measuring a width of the dye attached on the photosensitive drum 1 in this state.

Further, a contact region labeled "N" in FIG. 3 is a second contact region where the inner circumferential surface (the back surface) of the intermediate transfer belt 6 and the primary transfer brush 5 are in contact with each other, and is referred to as a back surface nip portion N. The back surface nip portion N is a region from a contact start point (start point) to a contact end point (end point) between the primary transfer brush 5 including the plurality of conductive fibers 51 and the inner circumferential surface of the intermediate transfer belt 6 in the movement direction of the intermediate transfer belt 6. In the present exemplary embodiment, the back surface nip portion N has a width of 3.0 mm in the movement direction of the intermediate transfer belt 6. The width of the back surface nip portion N is equal to the dimension W of the primary transfer brush 5 in the lateral direction.

Figure 4:
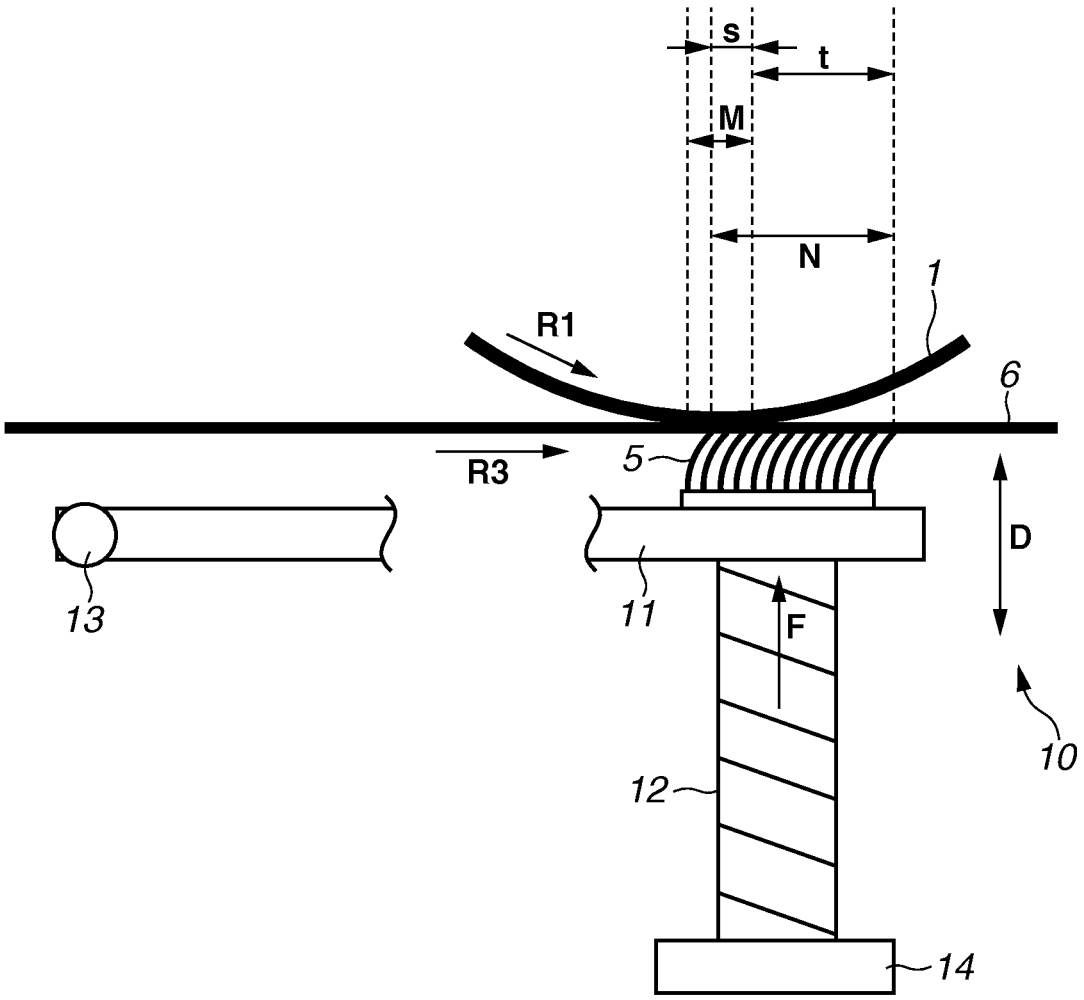
FIG. 4 illustrates a positional relationship among the contact regions when conductive fibers of the primary transfer brush according to the first exemplary embodiment are in a bent state.

FIG. 4 illustrates the primary transfer brush 5 in abutment with the intermediate transfer belt 6 in a state after the image forming apparatus 100 according to the present exemplary embodiment is used (in a well-used state, especially, in a state after the number of printed sheets reaches approximately 1000 pages). FIG. 4 also illustrates the positional relationship among the respective members and the respective nips at the primary transfer portion B1. At the primary transfer brush 5 according to the present exemplary embodiment, in the used state, the conductive fibers 51 are tilted toward a downstream side along the movement direction R3 of the intermediate transfer belt 6, and are in contact with the inner circumferential surface of the intermediate transfer belt 6 in a bent state.

As illustrated in FIG. 3, at the primary transfer brush 5 in the initial state, the conductive fibers 51 are hardly bent with only a slight bend amount although they are in contact with the moving intermediate transfer belt 6, and are erected substantially perpendicularly to the base plate 52. However, as illustrated in FIG. 4, at the primary transfer brush 5 in the used state, the conductive fibers 51 continuously receive a frictional force toward the downstream side in the movement direction of the intermediate transfer belt 6, from the inner circumferential surface of the moving intermediate transfer belt 6. Therefore, in the used state, each one of the fibers is bent, and is in contact with the back surface of the intermediate transfer belt 6 in a state tilted toward the downstream side in the movement direction of the intermediate transfer belt 6. In the present exemplary embodiment, a fiber tilt amount is 0.4 mm (described below).

A restoring force for correcting the bend is generated in the conductive fibers 51 according to the present exemplary embodiment, and this force serves as a force for pushing back the primary transfer brush 5 in the direction away from the intermediate transfer belt 6 (reaction force). Therefore, as illustrated in FIG. 4, the primary transfer brush 5 is stabilized with respect to the inner circumferential surface of the intermediate transfer belt 6 at a position reached by the primary transfer brush 5 advancing to a position where the biasing force F and the above-described reaction force are balanced. At this time, the primary transfer brush 5 advances toward the inner circumferential surface of the intermediate transfer belt 6 by an advance amount of 0.08 mm (described below).

A method for measuring this advance amount, and a method for comparing the above-described fiber tilt amount and the width of the physical nip M will be described below.

The support device 10 is configured in such a manner that the rotational shaft 13 and the primary transfer brush 5 are spaced apart from each other by a distance of 30 mm in the movement direction of the intermediate transfer belt 6. On the other hand, the primary transfer brush 5 advances toward the inner circumferential surface of the intermediate transfer belt 6 by the advance amount of 0.08 mm, which is sufficiently small compared to the distance of 30 mm. In other words, the support portion 11 illustrated in FIG. 4 only rotates by a just extremely small angle in the counterclockwise direction in FIG. 4, compared to the pedestal illustrated in FIG. 3. Therefore, even though the primary transfer brush 5 advances toward the inner circumferential surface of the intermediate transfer belt 6 in the used state, the primary transfer brush 5 can be considered to have only a parallel displacement toward the intermediate transfer belt 6. Therefore, the base plate 52 and the back surface of the intermediate transfer belt 6 are maintained in the substantially parallel relationship. The layout of the respective members in FIG. 4 is illustrated based on the premise of this condition.

Next, the positional relationship among the respective members and the respective contact regions at the primary transfer portion B1, which is important for continuously acquiring excellent primary transferability, will be described with reference to FIGS. 3 and 4. A region labeled "s" in FIGS. 3 and 4 is a third contact region. The third contact region indicates a region where the physical nip M and the back surface nip portion N overlap each other in the movement direction of the intermediate transfer belt 6 (overlap nip portion s). The overlap nip portion s is a region where a transfer electric field is formed. If the overlap nip portion s cannot be formed, this reduces the transfer electric field for primarily transferring the toner on the photosensitive drum 1 onto the intermediate transfer belt 6, thereby making it difficult to acquire the excellent primary transferability. In the present exemplary embodiment, the overlap nip portion s has a width of 1 mm in the movement direction of the intermediate transfer belt 6 in the initial state (FIG. 3), and has a width of 0.6 mm in the used state (FIG. 4) as a result of the above-described fiber tilt.

Next, a region labeled "t" in FIGS. 3 and 4 indicates a fourth contact region adjacent to the overlap nip portion s on the downstream side in the movement direction of the intermediate transfer belt 6, where only the primary transfer brush 5 is in contact with the intermediate transfer belt 6. The fourth contact region is referred to as a tension nip portion t. In other words, the region labeled "t" in FIGS. 3 and 4 indicates a region where the back surface nip portion N protrudes beyond the physical nip M on the downstream side in the movement direction of the intermediate transfer belt 6. An excessive electric charge supplied from the transfer electric field formed in the overlap nip portion s and remaining on the intermediate transfer belt 6 even after the intermediate transfer belt 6 passes through the overlap nip portion s is transmitted to the primary transfer brush 5 at the tension nip portion t to return.

The tension nip portion t is a region required to prevent an image defect from being generated, which otherwise is caused by an abnormal electric discharge due to the above-described excessive electric charge. In the present exemplary embodiment, the tension nip portion t has a width of 2 mm in the movement direction of the intermediate transfer belt 6 in the initial state (FIG. 3), and has a width of 2.4 mm in the used state (FIG. 4) as a result of the above-described fiber tilt.

In FIGS. 3 and 4, there is no region where the back surface nip portion N protrudes beyond the physical nip M on the upstream side in the movement direction of the intermediate transfer belt 6 (protruding nip). If there is the protruding nip, this leads to generation of a space where the transfer electric field is formed between the photosensitive drum 1 and the intermediate transfer belt 6, on the upstream side in the movement direction of the intermediate transfer belt 6 at the primary transfer portion B1. Therefore, this may cause such a phenomenon that a resultant image contains the toner scattered around because the toner is transferred from the photosensitive drum 1 onto the intermediate transfer belt 6 before the intermediate transfer belt 6 enters the primary transfer portion B1 (transfer scattering due to a premature transfer). Therefore, in the present exemplary embodiment, a positional relationship between the photosensitive drum 1 and the primary transfer brush 5 is adjusted in such a manner that a position of an upstream end of the physical nip M and a position of an upstream end of the back surface nip portion N coincide with each other in the movement direction of the intermediate transfer belt 6 in the initial state, to prevent the protruding nip from being formed.

It is necessary that the overlap nip portion s is formed and it is desirable that the tension nip portion t is formed, to acquire the excellent primary transferability.

In the present exemplary embodiment, the overlap nip portion s is formed so as to have the width of 1 mm and the tension nip portion t is formed so as to have the width of 2 mm when the image forming apparatus 100 is in the initial state. On the other hand, even in the used state, the widths of 0.6 mm and 2.4 mm are secured as the widths of the overlap nip portion s and the tension nip portion t, respectively. As a result, the excellent primary transferability can be continuously acquired.

A careful review of the configuration according to the present exemplary embodiment has revealed that the existence of the overlap nip portion s (the width s is wider than 0 mm, more desirably, wider than 0.1 mm), and the tension nip portion t having a width of 1 mm or wider can ensure that the primary transfer is carried out with excellent transferability. However, if the width of the overlap nip portion s is excessively wide, the toner image is scraped in the overlap nip portion s so that the image is disturbed. For this reason, normally, the width of the overlap nip portion s is adjusted to 5 mm or narrower. Further, if the width of the tension nip portion t is excessively wide, the intermediate transfer belt 6 and the primary transfer brush 5 are in contact with each other at a large area. In this case, the intermediate transfer belt 6 receives a strong sliding force from the primary transfer brush 5, so that the running stability is deteriorated. For this reason, normally, the width of the tension nip portion t is adjusted to 10 mm or narrower.

5. Comparison Between Fiber Tilt Amount and Width of Physical Nip M

Regarding the primary transfer brush 5 in the above-described used state, the method for measuring the advance amount and the method for comparing the fiber tilt amount with the width of the physical nip M will be described. The primary transfer brush 5 is measured in the following manner after being removed out of the image forming apparatus 100. FIGS. 5A, 5B, 5C, and 5D illustrate a method for measuring a relationship between a pressing force applied to the primary transfer brush 5 and the advance amount of the primary transfer brush 5. These drawings illustrate the primary transfer brush 5 laid on a horizontal table as viewed from the lateral direction of the primary transfer brush 5.

In this measurement, a spring tester having a model name of EZ Test EZ-S, which is manufactured by Shimadzu Corporation, is used as a measuring instrument. The spring tester includes a horizontal table 201, and allows the primary transfer brush 5 removed from the image forming apparatus 100, which is a measurement target, to be laid thereon. Further, the spring tester includes a pressure probe 202. The pressure probe 202 can contact the surface of the primary transfer brush 5 (brush fiber side) in parallel therewith and press the primary transfer brush 5 downwardly from vertically above. The pressure probe 202 includes a circular plate having a diameter of 20 mm (ϕ20), and a support rod. This pressure probe 202 is vertically movable while its position is controlled by an accompanying controller, and an advance amount u and a pressing force G can be monitored when the pressure probe 202 is placed into abutment with the surface of the primary transfer brush 5. Use of this measuring instrument realizes reproduction of the primary transfer brush 5 biased toward the intermediate transfer belt 6 in the image forming apparatus 100 with its fibers tilted, on the horizontal table 201.

The primary transfer brush 5 is laid on the horizontal table 201 so as to extend through a position to which a central portion of the circular plate of the pressure probe 202 will be lowered, and extend in parallel with an arbitrary diametrical portion of the circular plate. Further, the primary transfer brush 5 is laid on the horizontal table 201 while protruding beyond a region within which the circular plate of the pressure probe 202 will be lowered. However, normally, the primary transfer brush 5 is evenly configured in the longitudinal direction, whereby there is no problem as long as the primary transfer brush 5 can be measured only partially in the longitudinal direction thereof. It is apparent that, alternatively, the primary transfer brush 5 may be measured by processing in which the primary transfer brush 5 is measured a plurality of times i.e., measuring respective portions of the primary transfer brush 5 in the longitudinal direction thereof for each pitch of 20 mm (a pitch corresponding to the diameter of the circular plate of the pressure probe 202), and an average of measured values is calculated therefrom.

A force G0, which is exerted to reproduce the primary transfer brush 5 with its fibers tilted in the image forming apparatus 100 when the primary transfer brush 5 is pressed by the pressure probe 202, is defined in the following manner. The force G0 is obtained in such a manner that the biasing force F=3.92 N (400 gf) of the spring 12 of the image forming apparatus 100 is divided by the dimension K (230 mm) of the fibered portion 5α of the primary transfer brush 5, and then is multiplied by the diameter (20 mm) of the circular plate of the pressure probe 202. As a result, G0=0.34 N (34.7 gf) is obtained. Due to this definition, the pressing force applied by the pressure probe 202 to the primary transfer brush 5 per unit longitudinal dimension matches the biasing force applied to the primary transfer brush 5 mounted in the image forming apparatus 100 per unit longitudinal dimension.

Figure 6:
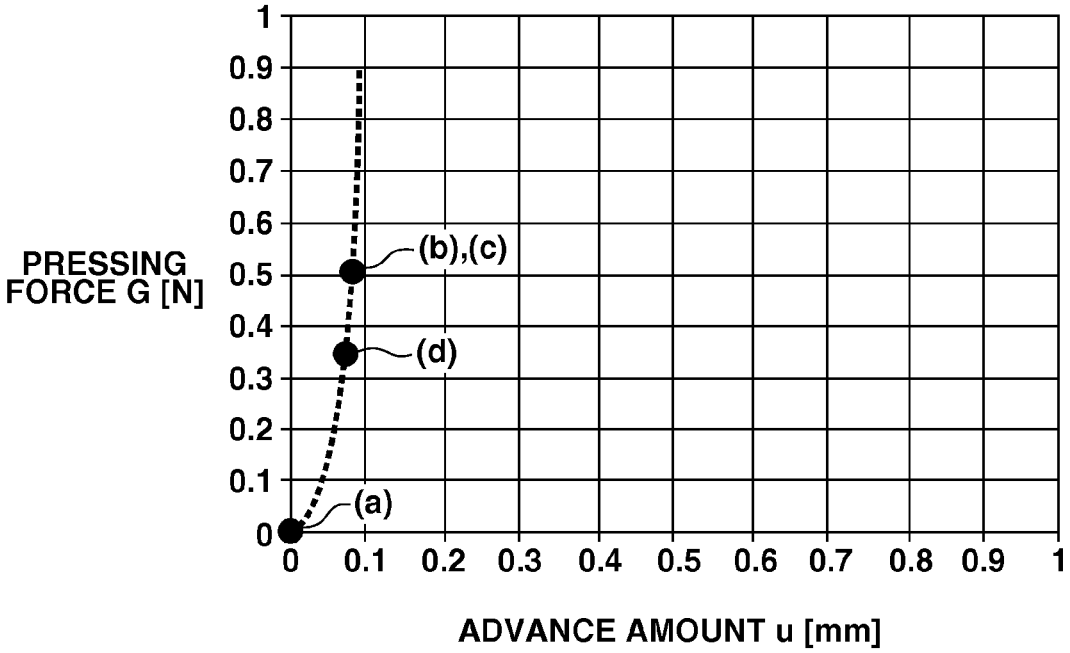
FIG. 6 illustrates a graph acquired from a measurement of a relationship between a pressing force applied to the primary transfer brush and an advance amount of the primary transfer brush according to the first exemplary embodiment.

Next, a measurement procedure will be described in detail. This procedure will be described together with values acquired when the primary transfer brush 5 according to the present exemplary embodiment is measured. FIG. 6 illustrates a graph where the values acquired during the measurement are plotted.

(1) The primary transfer brush 5 is laid on the horizontal table 201 of the spring tester.

Figure 5A:
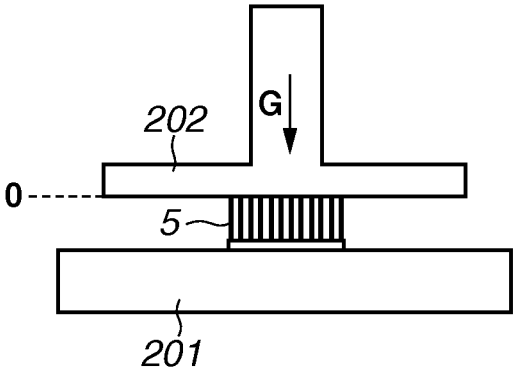
FIGS. 5A, 5B, 5C, and 5D illustrate a method for measuring a relationship between a pressing force applied to the primary transfer brush and an advance amount of the primary transfer brush according to the first exemplary embodiment.

(2) The pressure probe 202 is lowered from vertically above onto the surface of the primary transfer brush 5 to be brought into contact with the surface of the primary transfer brush 5, and a position of a bottom surface of the pressure probe 202 when the pressing force starts to be generated first is set as a reference position (a position 0 illustrated in FIGS. 5A, 5B, 5C, and 5D) of the advance amount u (FIG. 5A). At this time, G=0 N and u=0 mm. The acquired measurement result is plotted at a point (a) in FIG. 6.

Figure 5B:
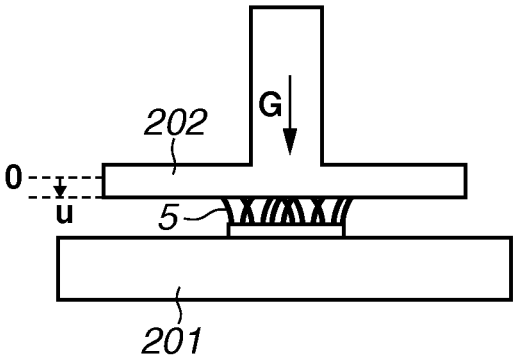

(3) The pressure probe 202 is further lowered to advance on the surface of the primary transfer brush 5, and reaches a position where the pressing force G becomes one and a half times as strong as G0, i.e., the pressing force G reaches 0.51 N. At this time, G=0.51 N and u=0.09 mm (FIG. 5B). The acquired measurement result at this time is plotted at a point (b) in FIG. 6.

Figure 5C:
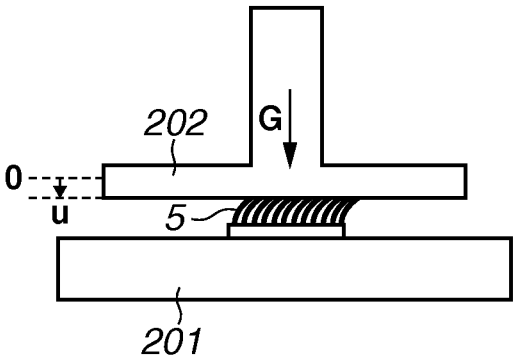

(4) An arbitrary sheet-like member having a thickness of approximately 50 to 100 um is inserted between the surface of the primary transfer brush 5 and the bottom surface of the pressure probe 202 so that the brush fibers are tilted in a same single direction all together (FIG. 5C). The brush fibers are tilted in a direction extending along the lateral direction of the primary transfer brush 5 and oriented toward the downstream side of the primary transfer brush 5 mounted in the image forming apparatus 100 (to the right in FIGS. 5A, 5B, 5C, and 5D). The measurement result acquired at this time is plotted at a point (c) in FIG. 6.

Figure 5D:
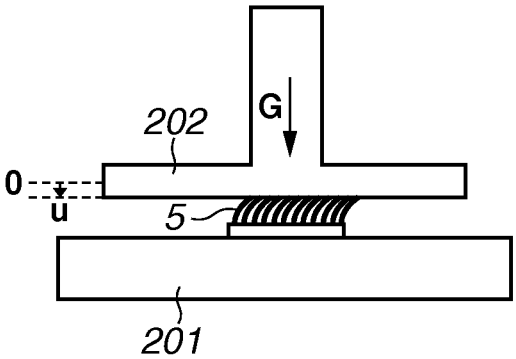

(5) The pressure probe 202 is moved upward, and is stopped at a position where the pressing force G decreases to G0 (FIG. 5D). At this time, G=G0=0.34 N and u=0.08 mm (point (d) in FIG. 6). The measurement result acquired at this time is plotted at the point (d) in FIG. 6. As a result of the execution of the process illustrated in FIG. 5D, the advance amount u is changed from u=0.09 mm to u=0.08 mm according to the shift from FIG. 5C to FIG. 5D. The advance amount u corresponding to the pressing force G0 with the fibers perfectly tilted can be accurately measured by performing the process (5) after performing the above-described processes (3) and (4). Further, the advance amount u acquired by the above-described process (5) corresponds to the advance amount by which the primary transfer brush 5 in the used state inside the image forming apparatus 100 according to the present exemplary embodiment advances toward the back surface of the intermediate transfer belt 6, and is set as a brush advance amount u0 (=0.08 mm).

Figure 7:
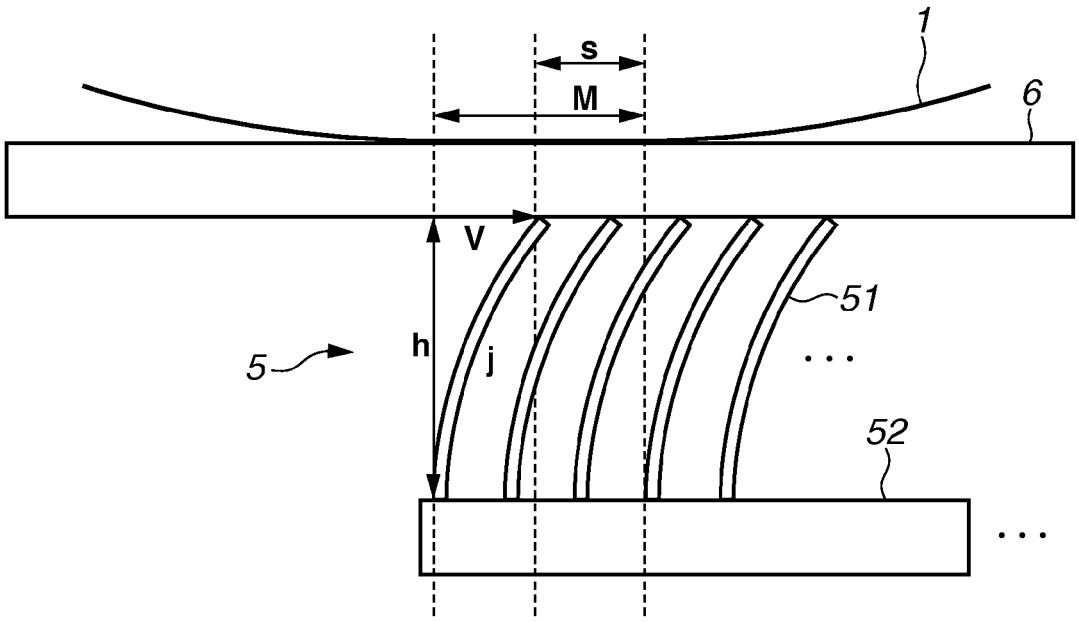
FIG. 7 illustrates a model for calculating a fiber tilt amount of the primary transfer brush according to the first exemplary embodiment.

The following calculation is made with use of the measured brush advance amount u0. FIG. 7 illustrates a model for facilitating better understanding of the brush fibers 51 in the bent state. FIG. 7 illustrates how the conductive fibers 51 of the primary transfer brush 5 in the used state are in contact with the inner circumferential surface of the intermediate transfer belt 6 while being in the bent state, in an enlarged manner. The bend of each one of the brush fibers 51 is shaped into a quadratic function curve that perpendicularly intersects with the base plate 52.

The fiber length j indicates the length of the conductive fiber 51. The primary transfer brush 5 according to the present exemplary embodiment has the fiber length j=1.3 mm. A brush thickness indicates a thickness of the primary transfer brush 5 as illustrated in FIG. 7. The brush thickness h can be calculated from the above-described brush advance amount u0 and the fiber length j by the following formula.

$$t=j-u0 \qquad \text{(FORMULA 2)}$$

The brush thickness h means a thickness of a fiber layer in the primary transfer brush 5 in the used state. As illustrated in FIG. 7, a distance from the surface of the support device 10 that supports the primary transfer brush 5 to the intermediate transfer belt 6 is set as the brush thickness h. The primary transfer brush 5 according to the present exemplary embodiment has the fiber length j=1.3 mm and the advance amount u0=0.08 mm. Therefore, t=1.22 mm.

Next, the brush fiber is tilted by a fiber tilt amount v as illustrated in FIG. 7. The fiber tilt amount v is an index defined in the following manner. This index indicates how much the conductive fiber 51 located at a most upstream portion on the primary transfer brush 5 in the movement direction of the intermediate transfer belt 6 is displaced toward the downstream side while being in contact with the intermediate transfer belt 6 in the used state, compared to this conductive fiber 51 when the intermediate transfer belt 6 is stopped.

In this case, the following formula is established among j, t, and v from the assumption that the brush fiber in the bent state is shaped into a quadratic function curve as described above.

$$j=\int_0^t \sqrt{1+\left(\frac{2v}{t^2}x\right)^2}\,dx \qquad \text{(FORMULA 3)}$$

The left side corresponds to the fiber length of the brush fiber, and the right side is integration of a length of a line along the posture of the brush fiber shaped into a quadratic function curve. The above-described formula 3 can be expanded in the following manner according to a mathematic formula.

$$j=v\sqrt{\frac{t^2}{4v^2}+1}+\frac{t^2}{4v^2}\ln\left\{\frac{2v}{t}\left(1+\sqrt{\frac{t^2}{4v^2}+1}\right)\right\} \qquad \text{(FORMULA 4)}$$

On the other hand, the following formula is a formula for comparing the fiber tilt amount and the physical nip M to determine which is larger.

$$V<M \qquad \text{(FORMULA 5)}$$

It can be said that the overlap nip portion s exists if the above-described formula 5 is satisfied, i.e., a maximum value of the fiber tilt amount is smaller than the width of the physical nip M. Because the right side of the formula 4 is a monotonous increase formula with respect to v, the following formula can be acquired by combining the above-described formulas 4 and 5.

$$j<M\sqrt{\frac{t^2}{4M^2}+1}+\frac{t^2}{4M^2}\ln\left\{\frac{2M}{t}\left(1+\sqrt{\frac{t^2}{4M^2}+1}\right)\right\} \qquad \text{(FORMULA 6)}$$

The right side of the above-described formula 6 expresses the fiber length of the primary transfer brush 5 that causes the fiber tilt amount to reach the width of the physical nip M. Therefore, if the fiber length j of the employed primary transfer brush 5 is shorter than the right side of the formula 6, it can be said that the fiber tilt amount in this case does not reach the width of the physical nip M. In other words, satisfying the above-described formula 6 is a condition for ensuring the existence of the overlap nip portion s and maintaining the excellent primary transferability even in the used state.

In the case of the primary transfer brush 5 according to the present exemplary embodiment, j=1.3 mm, t=1.22 mm, and M=1.0 mm. Substituting these values into the above-described formula 6 reveals that the above-described formula 6 can be satisfied in the present exemplary embodiment as 1.3 is set to the left side of the formula 6 and 1.64 is acquired from a calculation of the right side of the formula 6. Therefore, use of the primary transfer brush 5 according to the present exemplary embodiment can ensure the existence of the satisfactory overlap nip portion s even in the used state.

Then, v=0.4 mm, which is the fiber tilt amount v of the primary transfer brush 5 according to the present exemplary embodiment, can be acquired by solving the above-described formula 4 with use of the numerical values.

It is desirable that the position of the upstream end of the primary transfer brush 5 and the position of the upstream end of the physical nip M coincide with each other in the movement direction of the intermediate transfer belt 6. However, the position at which the primary transfer brush 5 is mounted with respect to the photosensitive drum 1 and the intermediate transfer belt 6 may be changed under the influence of, for example, a variation in positioning parts when the image forming apparatus 100 is assembled. In the image forming apparatus 100 according to the present exemplary embodiment, the position at which the primary transfer brush 5 is mounted may be changed within the range of approximately ±0.5 mm in a direction along the movement direction of the intermediate transfer belt 6. Such a change should be taken into consideration.

Therefore, the primary transfer brush 5 is mounted in the following manner when priority is placed on preventing the toner from being further largely scattered in the initial state due to the change in the position at which the primary transfer brush 5 is mounted. The primary transfer brush 5 is mounted in such a manner that the primary transfer brush 5 is disposed aiming slightly the downstream side so that the position of the upstream end of the back surface nip portion N is located on the downstream side in the movement direction of the intermediate transfer belt 6 (by approximately 0.5 mm) with respect to the position of the upstream end of the physical nip M. In this case, the overlap nip portion s slightly decreases in the initial state, but this is acceptable. In such a case, the fiber tilt amount being smaller than the width of the overlap nip portion s in the initial state is a condition for ensuring the existence of the overlap nip portion s and maintaining the excellent primary transferability even in the used state.

On the other hand, the primary transfer brush 5 is disposed aiming slightly the upstream side, when priority is placed on preventing the efficiency of the primary transfer from being impaired in the initial state due to the change in the position at which the primary transfer brush 5 is mounted. The primary transfer brush 5 is mounted in such a manner that the position of the upstream end of the back surface nip portion N is located on the upstream side in the movement direction of the intermediate transfer belt 6 (by approximately 0.5 mm) with respect to the position of the upstream end of the physical nip M. In this case, a slight protruding nip is formed in the initial state, but this is acceptable. In such a case, the fiber tilt amount being smaller than a sum of the width of the protruding nip and the width of the physical nip M in the initial state is a condition for ensuring the existence of the overlap nip portion s and maintaining the excellent primary transferability even in the used state.

6. Comparative Example

A comparative example to be compared with the present exemplary embodiment will be described. An image forming apparatus according to the comparative example (the present comparative example and another comparative example that will be described below) is configured substantially similarly to the image forming apparatus 100 according to the present exemplary embodiment except for a difference that will be pointed out especially. The comparative example will be described, designating elements having similar or corresponding functions or configurations to the image forming apparatus 100 according to the present exemplary embodiment by the same reference numerals.

In the present comparative example, a brush member according to the following specification is used as the primary transfer brush 5 having representative characteristics.

<Specification of Primary Transfer Brush According to Comparative Example>

MEMBER TYPE: PILE FABRIC

MATERIAL OF BRUSH FIBER: NYLON FIBER WITH CARBON POWDER DISTRIBUTED THEREIN

SINGLE FIBER FINENESS OF BRUSH FIBER: 2.5 dtex

FIBER DIAMETER OF BRUSH FIBER: 17 μm

YOUNG'S MODULUS OF BRUSH FIBER: 1500 MPa

RESISTIVITY OF BRUSH FIBER: $10^{4.9}$ Ωcm

FIBER LENGTH (j): 3.0 mm

ARRAY DENSITY: 418 F/mm$^2$

As understood from the above-described characteristics, the primary transfer brush 5 according to the comparative example has a similar specification to the primary transfer brush 5 according to the above-described exemplary embodiment of the present invention, except for the fact that the fiber length j is 3.0 mm. Further, the support device 10 of the primary transfer brush 5 is also configured similarly to the support device 10 according to the above-described exemplary embodiment of the present invention.

Figure 8:
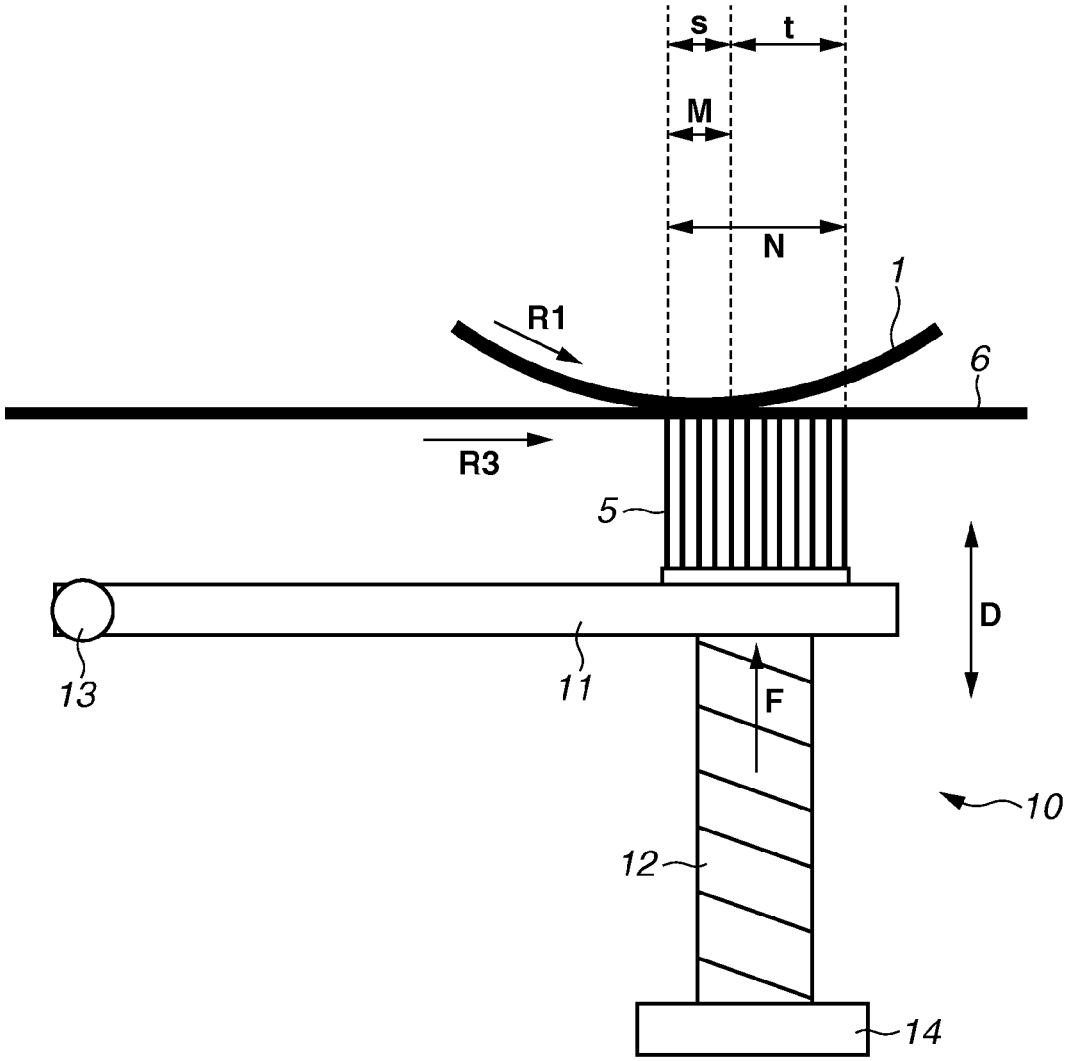
FIG. 8 illustrates a configuration of a support device of a primary transfer brush and a positional relationship among contact regions according to a comparative example.

FIG. 8 illustrates a positional relationship among the respective members and the respective contact regions at the primary transfer portion B1 in the image forming apparatus according to the present comparative example. FIG. 8 illustrates the image forming apparatus in the initial state.

According to the configuration of the present comparative example, the intermediate transfer belt 6 forms the physical nip M having a width of 1.0 mm in the movement direction of the intermediate transfer belt 6 between the photosensitive drum 1 and the intermediate transfer belt 6 for each station S.

Further, according to the configuration of the present comparative example, the back surface nip portion N has a width of 3.0 mm in the movement direction of the intermediate transfer belt 6.

Figure 9:
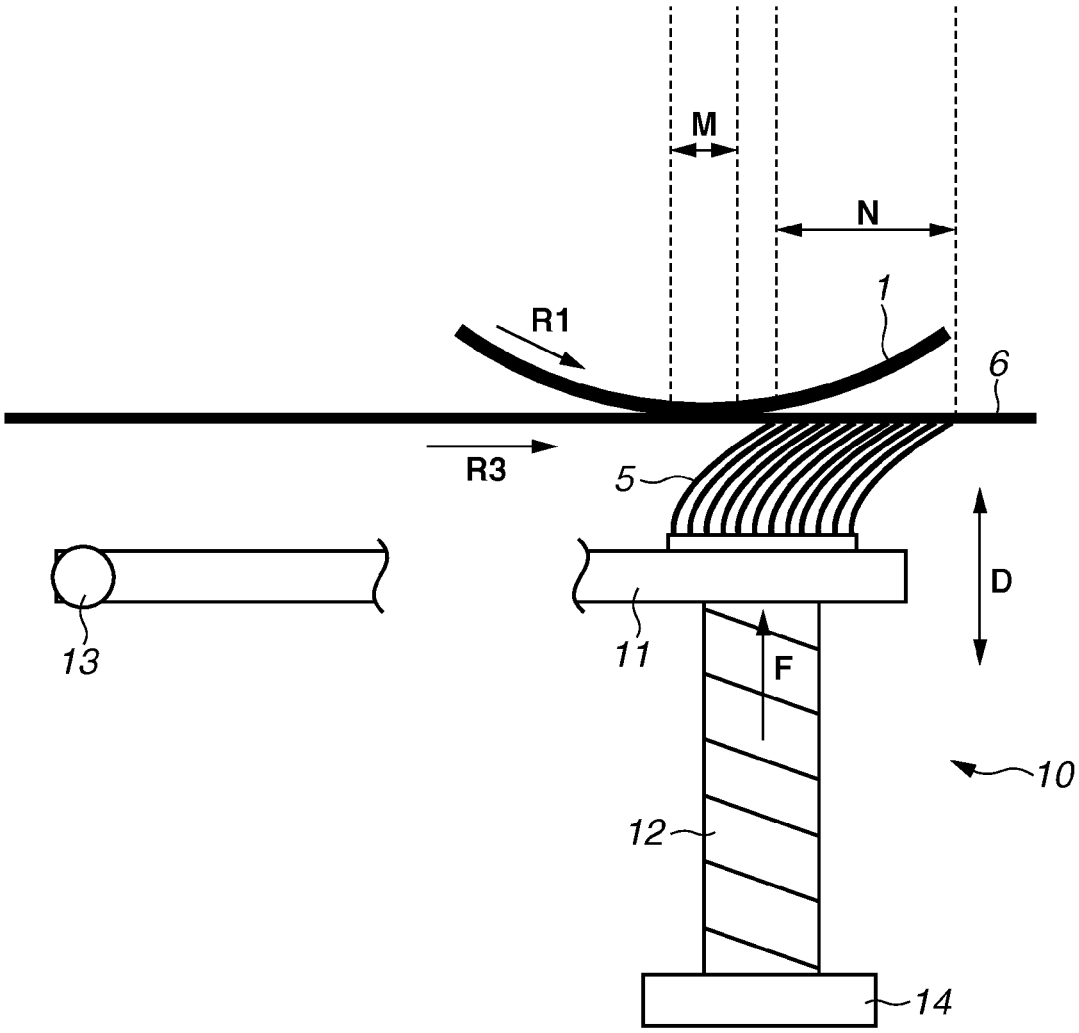
FIG. 9 illustrates a positional relationship among the contact regions when conductive fibers of the primary transfer brush according to the comparative example are in a bent state.

FIG. 9 illustrates the positional relationship among the respective members and the respective nips at the primary transfer portion B1 in the state after the image forming apparatus according to the present comparative example is used. At the primary transfer brush 5 according to the present comparative example, in the used state, the conductive fibers 51 are tilted toward the downstream side along the movement direction R3 of the intermediate transfer belt 6, and are in contact with the inner circumferential surface of the intermediate transfer belt 6 in the bent state.

In the present comparative example, the fiber tilt amount is 1.8 mm (which will be described below). Further, the primary transfer brush 5 advances toward the inner circumferential surface of the intermediate transfer belt 6 by an advance amount of 0.75 mm (which will be described below). FIG. 9 also illustrates the layout of the respective members based on the premise that the base plate 52 of the primary transfer brush 5 and the back surface of the intermediate transfer belt 6 are maintained in the substantially parallel relationship, in a similar manner to the above-described layout illustrated in FIG. 4.

Next, the positional relationship among the respective members and the respective nips at the primary transfer portion B1, which is important for acquiring the excellent primary transferability, will be described with reference to FIGS. 8 and 9. The overlap nip portion s illustrated in FIG. 8 has a width of 1 mm in the initial state. On the other hand, the overlap nip portion s does not exist in FIG. 9. In other words, the overlap nip portion s vanishes in the state after the image forming apparatus is used.

As illustrated in FIG. 8, the tension nip portion t has a width of 2 mm in the initial state. On the other hand, the tension nip portion t does not exist in FIG. 9, too. Because the tension nip portion t is a region that can achieve its effect only when the overlap nip portion s exists, the tension nip portion t does not exist when the overlap nip portion s does not exist. In other words, the tension nip portion t also vanishes in the state after the image forming apparatus is used. Both the overlap nip portion s and the tension nip portion t should be formed to acquire the excellent primary transferability. In the image forming apparatus according to the present comparative example, the overlap nip portion s and the tension nip portion t vanish in the used state. Therefore, the present comparative example cannot acquire the excellent primary transferability. Next, regarding the primary transfer brush 5 according to the present comparative example in the used state, the method for measuring the advance amount u and the method for comparing the fiber tilt amount v and the width of the physical nip M will be described.

The primary transfer brush 5 removed out of the image forming apparatus is measured in the following manner. FIGS. 10A, 10B, 10C, and 10D are schematic views illustrating this measurement. FIG. 11 illustrates a graph where values acquired during the measurement are plotted.

(1) The primary transfer brush 5 is laid on the horizontal table 201 of the spring tester.

Figure 10A:
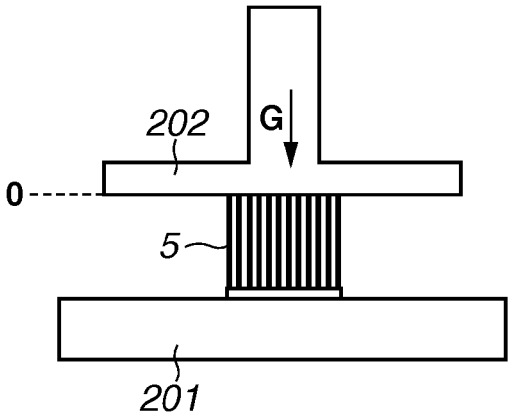
FIGS. 10A, 10B, 10C, and 10D illustrate a method for measuring a relationship between a pressing force applied to the primary transfer brush and an advance amount of the primary transfer brush according to the comparative example.

(2) The pressure probe 202 is lowered from vertically above onto the surface of the primary transfer brush 5 to be brought into contact with the surface of the primary transfer brush 5, and the position of the bottom surface of the pressure probe 202 when the pressing force G starts to be generated first is set as the reference position (position 0 illustrated in FIGS. 10A, 10B, 10C, and 10D) of the advance amount u (FIG. 10A). At this time, G=0 N and u=0 mm. The acquired measurement result is plotted at a point (a) in FIG. 11.

Figure 10B:
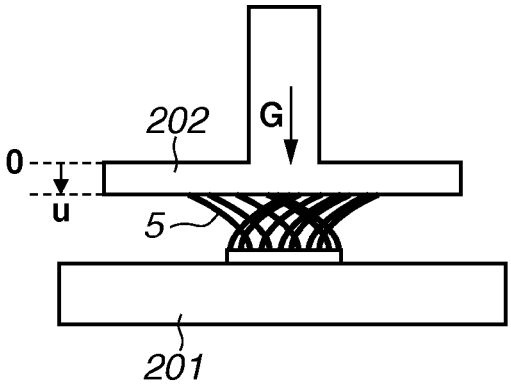
Figure 11:
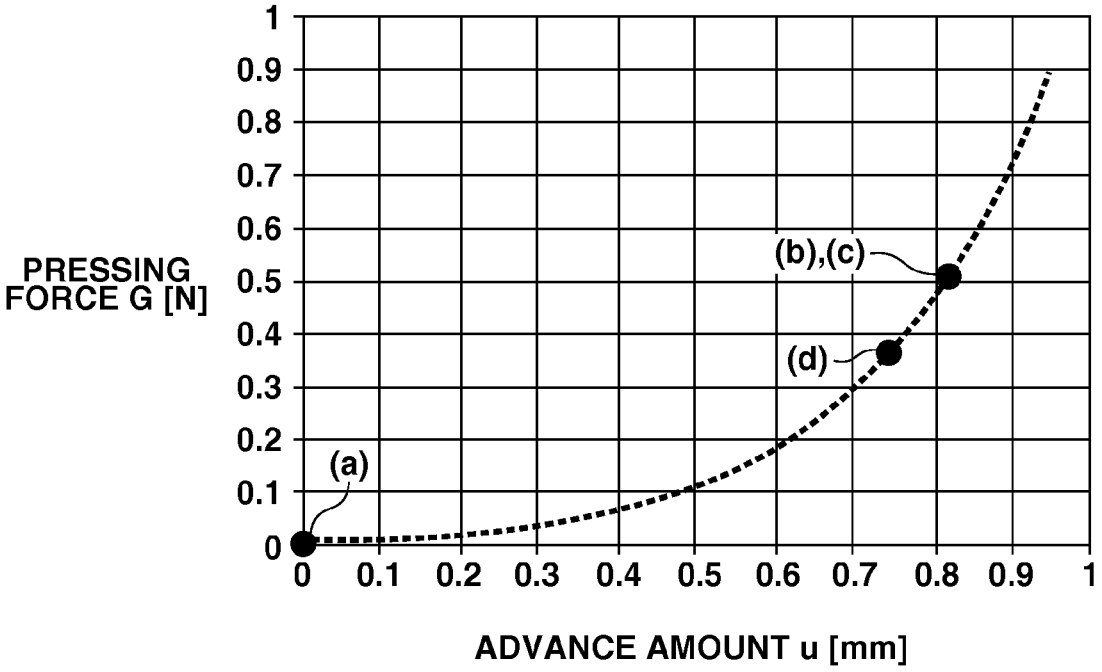
FIG. 11 illustrates a graph acquired from the measurement of the relationship between the pressing force applied to the primary transfer brush and the advance amount of the primary transfer brush according to the comparative example.

(3) The pressure probe 202 is further lowered to advance on the surface of the primary transfer brush 5, and reaches a position where the pressing force G becomes one and a half times as strong as G0, i.e., the pressing force G reaches 0.51 N (FIG. 10B). At this time, G=0.51 N and u=0.81 mm, and the acquired measurement result is plotted at a point (b) in FIG. 11.

Figure 10C:
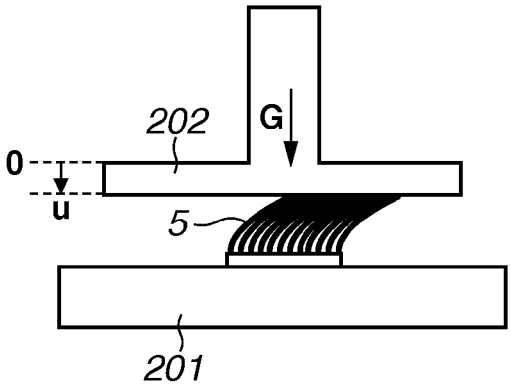

(4) A sheet-like member is inserted between the surface of the primary transfer brush 5 and the bottom surface of the pressure probe 202 so that the brush fibers are tilted in a same single direction all together (FIG. 10C). The measurement result acquired at this time is plotted at a point (c) in FIG. 11.

Figure 10D:
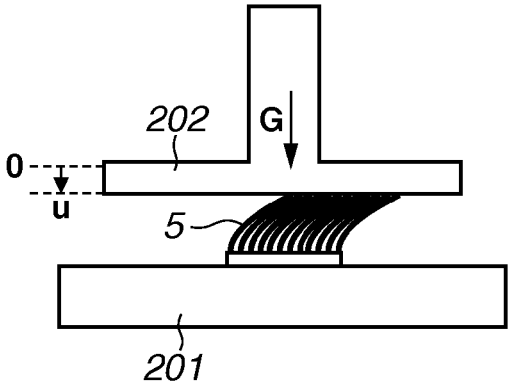

(5) The pressure probe 202 is moved upward, and is stopped at a position where the pressing force G decreases to G0 (FIG. 10D). At this time, G=G0=0.34 N and u=0.75 mm. The measurement result acquired at this time is plotted at a point (d) in FIG. 11.

The advance amount u acquired by the above-described process (5) corresponds to the advance amount by which the primary transfer brush 5 according to the present comparative example in the used state advances toward the back surface of the intermediate transfer belt 6, and is set as the brush advance amount u0 (=0.75 mm).

Figure 12:
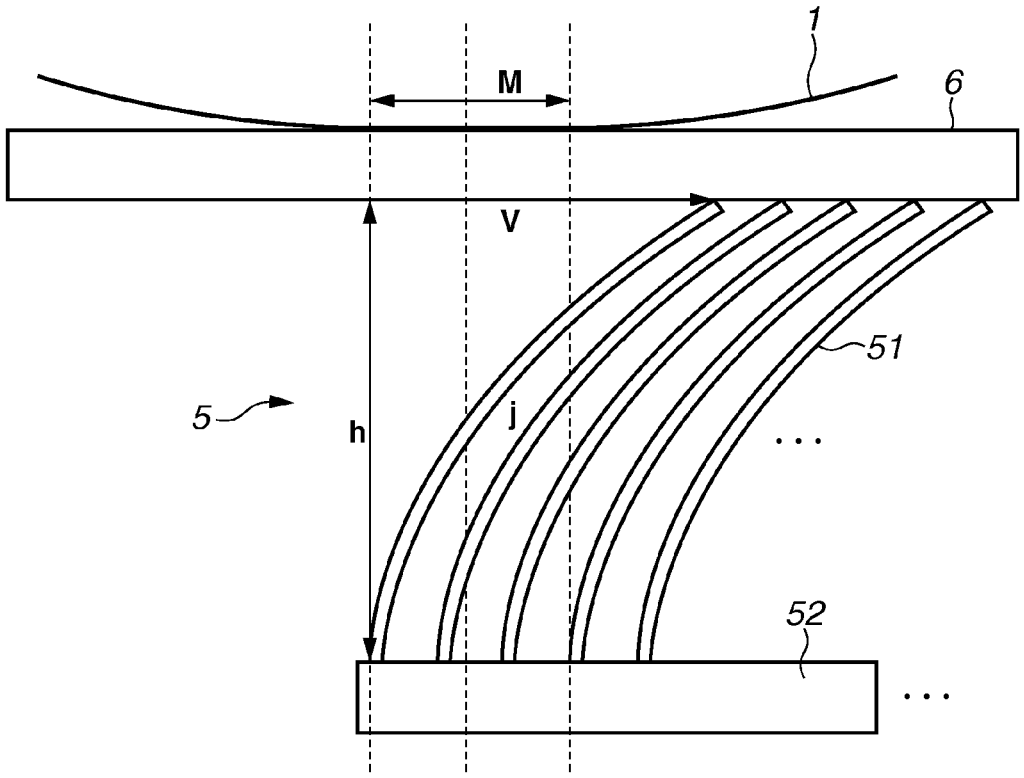
FIG. 12 illustrates a model for calculating a fiber tilt amount of the primary transfer brush according to the comparative example.

The following calculation is made with use of the measured brush advance amount u0. FIG. 12 illustrates a model that expresses the bend of the conductive fiber 51. The fiber length j indicates the length of the conductive fiber 51. The primary transfer brush 5 according to the present comparative example has the fiber length j=3.0 mm. The brush thickness h indicates the thickness of the primary transfer brush 5 as illustrated in FIG. 12. The primary transfer brush 5 according to the present comparative example has the fiber length j=3.0 mm and the advance amount u0=0.75 mm. Therefore, t=2.25 mm according to the above described formula 2. The brush fiber is tilted by the fiber tilt amount v as illustrated in FIG. 12. Further, according to the configuration of the present comparative example, the overlap nip portion s does not exist.

In the case of the primary transfer brush 5 according to the present comparative example, j=3.0 mm, t=2.25 mm, and the width of the physical nip M=1.0 mm. Substituting these values into the above-described formula 6 reveals that the formula 6 cannot be satisfied as 3.0 is set to the left side of the formula 6 and 2.52 is acquired from a calculation of the right side of the formula 6. Therefore, use of the primary transfer brush 5 according to the present comparative example leads to a loss of the overlap nip portion s in the used state. Then, v=1.8 mm, which is the fiber tilt amount v of the primary transfer brush 5 according to the present comparative example, can be acquired by solving the above-described formula 4 with use of the numerical values.

As described in detail above, according to the present exemplary embodiment, the fiber tilt amount v of the conductive fiber 51 is smaller than the width of the physical nip M formed between the photosensitive drum 1 and the intermediate transfer belt 6. Therefore, even in the state after the image forming apparatus 100 is used, the image forming apparatus 100 can prevent the region where the back surface nip portion N formed between the primary transfer brush 5 and the intermediate transfer belt 6, and the above-described physical nip M overlap each other from vanishing, thereby maintaining the excellent primary transferability.

As described above, the brush thickness h is an amount acquired by laying the primary transfer brush 5 on the spring tester and actually measuring the primary transfer brush 5. Examples of factors that determine the brush thickness t include the biasing force of the spring 12 in the image forming apparatus 100, and the single fiber fineness, the diameter of the fiber, the Young's modulus, and the array density in addition to the fiber length j of the brush fiber as the specification of the primary transfer brush 5. Generally, when the fiber length j does not change, the brush thickness h of the primary transfer brush 5 increases as the single fiber fineness increases, the diameter of the fiber increases, the Young's modulus increases, and the array density increases. On the other hand, the brush thickness h of the primary transfer brush increases as the single fiber fineness decreases, the diameter of the fiber decreases, the Young's modulus decreases, and the array density decreases. The primary transfer brush 5 can be said to be able to maintain the excellent primary transferability as long as actually measured value of the brush thickness h, the fiber length j, and the width of the physical nip M are in a relationship that can satisfy the above-described formula 6, no matter how the brush is configured.

The first exemplary embodiment has been described based on the image forming apparatus 100 configured in such a manner that the primary transfer brush 5 is placed into abutment with the inner circumferential surface of the intermediate transfer belt 6 by the support device 10 including the rotational shaft 13. On the other hand, a second exemplary embodiment is characterized in that the image forming apparatus 100 is configured in such a manner that the primary transfer brush 5 is placed into abutment with the inner circumferential surface of the intermediate transfer belt 6 by a support device fixed while being directly positioned with respect to a frame of the image forming apparatus 100 with use of a screw or the like. Other than that, the second exemplary embodiment is configured similarly to the image forming apparatus 100 according to the first exemplary embodiment, whereby the second exemplary embodiment will be described, by designating similar portions by the same reference numerals.

Figure 13:
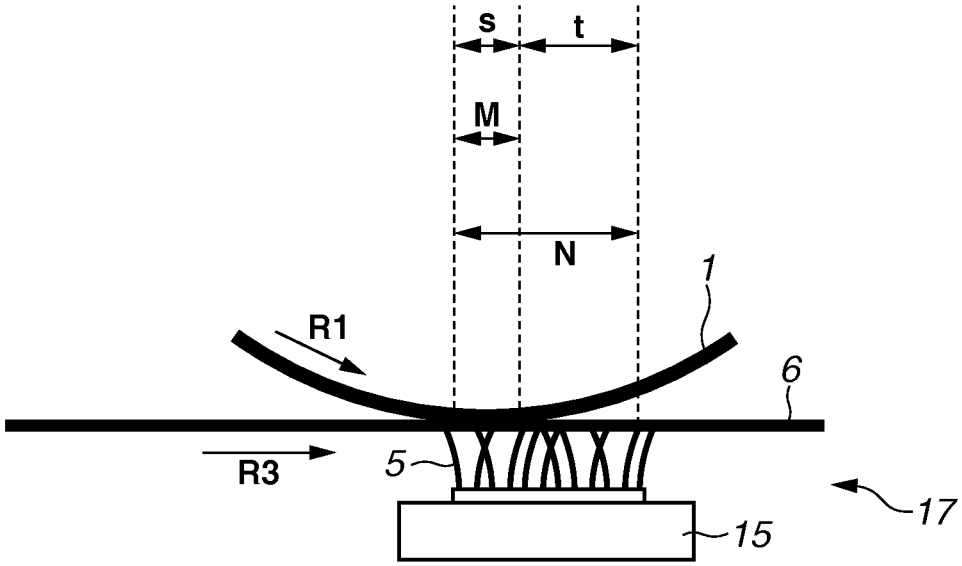
FIG. 13 illustrates a configuration of a support device of a primary transfer brush and respective contact regions according to a second exemplary embodiment.

FIG. 13 is a cross-sectional view illustrating a support device 17 of the primary transfer brush 5 at the primary transfer portion B1 of the image forming apparatus 100 according to the present exemplary embodiment. FIG. 13 illustrates the image forming apparatus 100 in the initial state. The primary transfer portions B1a to B1d of the respective stations Sa to Sd are configured similarly to one another.

The primary transfer brush 5 of the image forming apparatus 100 according to the present exemplary embodiment is brought into contact with the inner circumferential surface of the intermediate transfer belt 6 by the support device 17. The support device 17 includes a pedestal 15 as a fixed member directly positioned with respect to a frame of the image forming apparatus 100 with use of a screw. The primary transfer brush 5 is supposed by this pedestal 15. The bottom surface of the base plate 52 of the primary transfer brush 5 is fixed to a top surface of the pedestal 5 by a method such as adhesion, welding, fastening, and engagement, and is held onto the pedestal 15. In the present exemplary embodiment, the top surface of the pedestal 15 has a substantially similar shape to the bottom surface of the base plate 52 of the primary transfer brush 5. The primary transfer brush 5 is brought into contact with the inner circumferential surface of the intermediate transfer belt 6 by the pedestal 15.

In the present exemplary embodiment, the primary transfer brush 5 is in contact with the inner circumferential surface of the intermediate transfer belt 6 substantially perpendicularly thereto, as viewed in a cross-section perpendicular to the rotational axial direction of the photosensitive drum 1. Further, as viewed in this cross-section, the conductive fibers 51 of the primary transfer brush 5 are substantially perpendicularly in contact with the back surface of the intermediate transfer belt 6. In the present exemplary embodiment, the primary transfer brush 5 advances toward the back surface of the intermediate transfer belt 6 by an advance amount v=0.08 mm by the fixed support device 17.

A layout of the respective nips at the primary transfer portion B1 will be described. FIG. 13 also illustrates a positional relationship among the respective members and the respective nips at the primary transfer portion B1.

A region labeled "M" in FIG. 13 is the contact region formed between the photosensitive drum 1 and the intermediate transfer belt 6, and is referred to as the physical nip M. In the present exemplary embodiment, the physical nip M is formed so as to have a width of 1.0 mm.

Further, a region labeled "N" in FIG. 13 is the contact region formed between the intermediate transfer belt 6 and the primary transfer brush 5, and is referred to as the back surface nip portion N. In the present exemplary embodiment, the back surface nip portion N has a width of 3.0 mm in the movement direction of the intermediate transfer belt 6.

At the primary transfer brush 5 according to the present exemplary embodiment, the brush fibers are tilted in random directions in the initial state. Therefore, there are a small number of fibers sticking out and contacting the back surface of the intermediate transfer belt 6 outside the back surface nip portion N on the upstream and downstream sides of the back surface nip portion having the width N, although they are too few to affect the primary transferability, i.e., to cause an image defect such as toner scattering.

Figure 14:
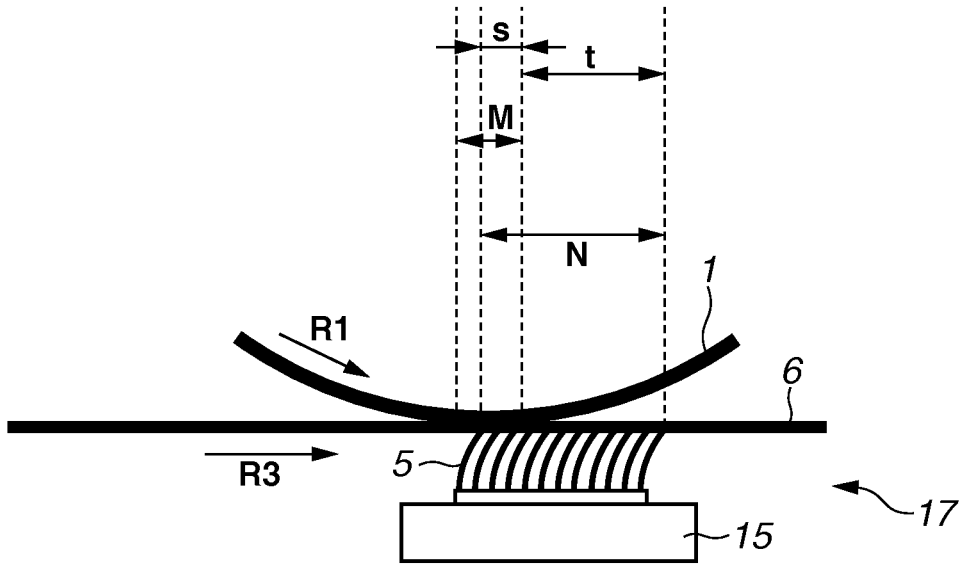
FIG. 14 illustrates a positional relationship among the contact regions when conductive fibers of the primary transfer brush according to the second exemplary embodiment are in the bent state.

On the other hand, FIG. 14 illustrates the primary transfer brush 5 in abutment with the intermediate transfer belt 6 in the state after the image forming apparatus 100 according to the present exemplary embodiment is used. FIG. 14 also illustrates the positional relationship among the respective members and the respective nips at the primary transfer portion B1.

At the primary transfer brush 5 according to the present exemplary embodiment, in the used state, the conductive fibers 51 are tilted toward the downstream side along the movement direction R3 of the intermediate transfer belt 6, and are in contact with the back surface of the intermediate transfer belt 6 while all of the fibers are bent uniformly.

As illustrated in FIG. 13, at the primary transfer brush 5 in the initial state, the conductive fibers 51 are tilted randomly. However, as illustrated in FIG. 14, at the primary transfer brush 5 in the used state, the conductive fibers 51 continuously receive the frictional force toward the downstream side in the movement direction of the intermediate transfer belt 6, from the back surface of the moving intermediate transfer belt 6. Therefore, when a printing operation is repeatedly performed so that the primary transfer brush 5 is placed into the used state, each one of the fibers is bent so as to be tilted toward the downstream side in the movement direction of the intermediate transfer belt 6. In the present exemplary embodiment, the fiber tilt amount is 0.4 mm (which will be described below).

Next, the positional relationship among the respective members and the respective nips at the primary transfer portion B1, which is important for acquiring the excellent primary transferability, will be described with reference to FIGS. 13 and 14.

A region labeled "s" in FIGS. 13 and 14 indicates the region where the physical nip M and the back surface nip portion N overlap each other (the overlap nip). In the present exemplary embodiment, the overlap nip portion s has a width of 1 mm in the initial state (FIG. 13), and has a width of 0.6 mm in the used state (FIG. 14) as a result of the above-described fiber tilt.

Next, a region labeled "t" in FIGS. 13 and 14 indicates the tension nip portion adjacent to the overlap nip portion s on the downstream side. In the present exemplary embodiment, the tension nip portion t has a width t of 2 mm in the initial state (FIG. 13), and has a width t of 2.4 mm in the used state (FIG. 14) as a result of the above-described fiber tilt.

In the present exemplary embodiment, the widths of 1 mm and 2 mm are secured as the widths of the overlap nip portion s and the tension nip portion t, respectively, when the image forming apparatus 100 is in the initial state. On the other hand, the widths of 0.6 mm and 2.4 mm are secured as the widths of the overlap nip portion s and the tension nip portion t, respectively, even in the used state. As a result, the present exemplary embodiment can continuously acquire the excellent primary transferability.

Regarding the primary transfer brush 5 in the above-described used state, the method for comparing the fiber tilt amount and the width of the physical nip M will be described. In the image forming apparatus 100 according to the present exemplary embodiment, the primary transfer brush 5 is supported by the fixed support device 17, and the amount by which the primary transfer brush 5 advances toward the back surface of the intermediate transfer belt 6 is the brush advance amount u0=0.08 mm in both the initial state and the used state. A similar calculation to the calculation described in the first exemplary embodiment is made with use of this brush advance amount u0.

A model that expresses the bend of the brush fiber is similar to the model illustrated in FIG. 7.

The fiber length j of the primary transfer brush 5 according to the present exemplary embodiment is j=1.3 mm. The brush thickness h is determined from the brush advance amount u0 and the fiber length j according to the above-described formula 2, and t=1.22 mm.

In the case of the primary transfer brush 5 according to the present exemplary embodiment, j=1.3 mm, t=1.22 mm, and M=1.0 mm. Substituting these values into the above-described formula 6 reveals that the formula 6 can be satisfied as 1.3 is set to the left side of the formula 6 and 1.64 is acquired from a calculation of the right side. Therefore, the primary transfer brush 5 according to the present exemplary embodiment can ensure the existence of the overlap nip portion s even in the used state. Then, v=0.4 mm, which is the fiber tilt amount v of the primary transfer brush 5 according to the present exemplary embodiment, can be acquired by solving the above-described formula 4 with use of numerical values.

According to the present exemplary embodiment, the image forming apparatus 100 including the fixed support device 17 of the primary transfer brush 5 can ensure that the maximum value of the fiber tilt amount of the conductive fiber 51 is smaller than the width of the physical nip M formed between the photosensitive drum 1 and the intermediate transfer belt 6. Therefore, even in the state after the image forming apparatus 100 is used, the image forming apparatus 100 can secure the region s where the back surface nip portion N formed between the primary transfer brush 5 and the intermediate transfer belt 6 and the physical nip M overlap each other, thereby maintaining the excellent primary transferability.

Use of the fixed support device 17 has a merit of a reduction in the number of parts and simplification of the configuration that lead to cost-reduction, compared to the support device 10 including the rotational shaft 13 according to the first exemplary embodiment.

Other Exemplary Embodiments

Though the present invention according to specific exemplary embodiments has been described above, the present invention is not limited to the above-described exemplary embodiments.

In the above-described exemplary embodiments, the examples regarding the pressing type abutment configuration and the fixed type abutment configuration have been described as the configuration that brings the transfer member in the form of a brush into abutment with the back surface of the intermediate transfer belt in the image forming apparatus, by introducing one example for each of them. However, another configuration may be employed as the configuration that establishes abutment of the transfer member in the form of a brush.

Examples of the pressing type abutment configuration include a configuration that uses a member such as a guide rail for limiting the movement direction of the transfer member in the form of a brush to a linear direction, and biases the transfer member in the form of a brush along the guide rail by a pressing spring into abutment with the back surface of the intermediate transfer belt. Further, the transfer member in the form of a brush may be fixed onto a sheet member, a sponge member, or the like as a method for holding the transfer member in the form of a brush, regardless of whether the abutment configuration is the pressing type configuration or the fixed type configuration. Then, for example, the transfer member in the form of a brush may be biased by a pressing spring into abutment with the back surface of the intermediate transfer belt after being fixed, which is one possible configuration. Alternatively, the transfer member in the form of a brush may be brought into contact with the inner circumferential surface of the intermediate transfer belt 6 by using elasticity of the sheet member or the sponge member itself, without using the pressing spring.

Further, the above-described exemplary embodiments have been described assuming that the image forming apparatus 100 is an image forming apparatus according to the intermediate transfer method that employs the intermediate transfer belt 6 as the transfer belt. However, the present invention can be also applied to an image forming apparatus configured in another manner. For example, examples of image forming apparatuses to which the present invention is applicable include an image forming apparatus according to the direct transfer method that sequentially directly transfers toner images formed on a plurality of photosensitive drums onto a transfer material being conveyed on a conveyance belt used as the transfer belt. The present invention can be also applied as a configuration of respective transfer members and support devices thereof in such an image forming apparatus according to the direct transfer method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-225591 filed Oct. 30, 2013, which is hereby incorporated by reference herein in its entirety.

What is claimed is:

1. An image forming apparatus comprising:

an image bearing member configured to bear a toner image;

an endless transfer belt movable while being in contact with the image bearing member;

a transfer device configured to transfer the toner image from the image bearing member to the transfer belt, and including a plurality of conductive fibers having one-end sides in contact with an inner circumferential surface of the transfer belt; and a support device configured to support the other-end sides of the plurality of conductive fibers, wherein the plurality of conductive fibers is supported by the support device in a pressed state between the support device and the transfer belt, wherein each of the conductive fibers is configured in such a manner that a tilt amount of the one-end side of the conductive fiber, which is generated as the transfer belt moves from a stopped state, is smaller than a length of a region where the image bearing member and the transfer belt are in contact with each other in a movement direction of the transfer belt, and wherein the support device moves the transfer device about a rotational shaft in a direction toward and a direction away from the transfer belt.

2. The image forming apparatus according to claim 1, wherein the following formula (1) is satisfied, assuming that j represents a length of the conductive fiber, t represents a distance from a surface of the support device that supports the plurality of conductive fibers to the transfer belt, and M represents the length of the region where the image bearing member and the transfer belt are in contact with each other in the movement direction of the transfer belt, $$j < M\sqrt{\frac{t^2}{4M^2}+1} + \frac{t^2}{4M^2}\ln\left\{\frac{2M}{t}\left(1+\sqrt{\frac{t^2}{4M^2}+1}\right)\right\}. \quad \text{(FORMULA 1)}$$

3. The image forming apparatus according to claim 1, wherein the conductive fiber located on a most upstream side is in contact with the transfer belt on a downstream side with respect to an upstream end of the region where the image bearing member and the transfer belt are in contact with each other in the movement direction of the transfer belt.

4. The image forming apparatus according to claim 1, wherein a part of the plurality of conductive fibers is in contact with the transfer belt on a downstream side with respect to the region where the image bearing member and the transfer belt are in contact with each other in the movement direction of the transfer belt.

5. The image forming apparatus according to claim 1, wherein the support device includes a support portion configured to support a base plate of the conductive fibers, and a biasing member configured to bias the support portion toward a transfer belt side.

6. The image forming apparatus according to claim 1, wherein the support device includes a fixed support portion configured to support a base plate of the transfer device.

7. The image forming apparatus according to claim 1, wherein the plurality of conductive fibers is formed into a brush-like state by pile weaving.

8. The image forming apparatus according to claim 1, wherein the plurality of conductive fibers is formed into a brush-like state by electrostatic flocking.

9. The image forming apparatus according to claim 1, wherein a fiber of the conductive fiber is a nylon fiber with carbon powder distributed therein.

10. The image forming apparatus according to claim 1, wherein a single fiber fineness of the conductive fiber is 1 to 15 dtex.

11. The image forming apparatus according to claim 1, wherein a Young's modulus of the conductive fiber is 500 to 3000 MPa.

12. The image forming apparatus according to claim 1, wherein a length of the conductive fiber is 0.5 to 2.5 mm.

13. The image forming apparatus according to claim 1, wherein an array density of the conductive fibers is 200 to 800 $F/m^2$.

14. The image forming apparatus according to claim 1, further comprising as the image bearing member a plurality of image bearing members configured to bear toner images of different colors, respectively, and d a plurality of transfer devices disposed so as to correspond to the plurality of image bearing members, wherein the transfer belt is an intermediate transfer belt onto which the toner images are transferred from the plurality of image bearing members.

* * * * *